US011154924B2

(12) United States Patent
Faoro

(10) Patent No.: US 11,154,924 B2
(45) Date of Patent: Oct. 26, 2021

(54) PROCESS AND APPARATUS FOR PRODUCING METAL INGOTS

(71) Applicant: IKOI S.P.A., Cassola (IT)

(72) Inventor: Giovanni Faoro, Bassano del Grappa (IT)

(73) Assignee: IKOI S.P.A., Cassola (IT)

( * ) Notice: Subject to any disclaimer, the term of this patent is extended or adjusted under 35 U.S.C. 154(b) by 0 days.

(21) Appl. No.: 16/960,330

(22) PCT Filed: Jan. 8, 2019

(86) PCT No.: PCT/IB2019/050120
§ 371 (c)(1),
(2) Date: Jul. 7, 2020

(87) PCT Pub. No.: WO2019/138318
PCT Pub. Date: Jul. 18, 2019

(65) Prior Publication Data

US 2021/0053109 A1 Feb. 25, 2021

(30) Foreign Application Priority Data

Jan. 9, 2018 (IT) ..... 102018000000651

(51) Int. Cl.
*B22D 7/00* (2006.01)
*B22D 9/00* (2006.01)
(Continued)

(52) U.S. Cl.
CPC ..... *B22D 7/005* (2013.01); *B22D 9/00* (2013.01); *B22D 7/064* (2013.01); *B22D 23/06* (2013.01); *B22D 27/003* (2013.01)

(58) Field of Classification Search
CPC . B22D 7/00; B22D 7/005; B22D 7/06; B22D 7/064; B22D 9/00; B22D 9/03;
(Continued)

(56) References Cited

U.S. PATENT DOCUMENTS

2002/0104596 A1 8/2002 Crafton et al.
2014/0041825 A1 2/2014 Faoro
2017/0182549 A1 6/2017 Faoro

FOREIGN PATENT DOCUMENTS

CN 101585082 A 11/2009
CN 102554183 A 7/2012
(Continued)

OTHER PUBLICATIONS

International Search Report dated Jul. 9, 2019 in PCT/IB2019/050120, 4 pages.
(Continued)

*Primary Examiner* — Kevin P Kerns
*Assistant Examiner* — Steven S Ha
(74) *Attorney, Agent, or Firm* — Element IP, PLC

(57) ABSTRACT

A process for producing metal ingots includes the steps of: a) filling at least one ingot mould at a filling temperature with at least one metal charge in the solid state, which has a melting temperature higher than ambient temperature, b) melting the metal charge by heating the ingot mould to a heating temperature higher than or equal to the melting temperature of the metal charge, c) solidifying the molten metal charge into an ingot by cooling the ingot mould to a cooling temperature lower than the melting temperature of the metal charge and higher than the ambient temperature, d) extracting the ingot from the ingot mould at an extraction temperature, and e) repeating steps a) to d). At steady state, both the filling temperature and the extraction temperature are lower than or equal to the cooling temperature and higher than the ambient temperature.

27 Claims, 23 Drawing Sheets

(51) Int. Cl.

| | |
|---|---|
| *B22D 7/06* | (2006.01) |
| *B22D 23/06* | (2006.01) |
| *B22D 27/00* | (2006.01) |

(58) Field of Classification Search
CPC ..... B22D 23/06; B22D 27/003; B22D 27/04; B22D 27/15; B22D 29/00; B22D 29/04
See application file for complete search history.

(56) References Cited

FOREIGN PATENT DOCUMENTS

| | | | |
|---|---|---|---|
| CN | 106061654 | A | 10/2016 |
| CN | 205904403 | U | 1/2017 |
| IT | 1997A000108 | | 1/1999 |
| JP | H11-1729 | A | 1/1999 |
| WO | WO-2012130451 | A1 | 10/2012 |
| WO | WO-2015083135 | A1 | 6/2015 |

OTHER PUBLICATIONS

Written Opinion dated Jul. 9, 2019 in PCT/IB2019/050120, 9 pages.
Combined Office Action and Search Report dated Apr. 14, 2021 in Chinese Patent Application No. 201980007756.X (with English translation of the Office Action and English translation of categories).

Fig. 7A
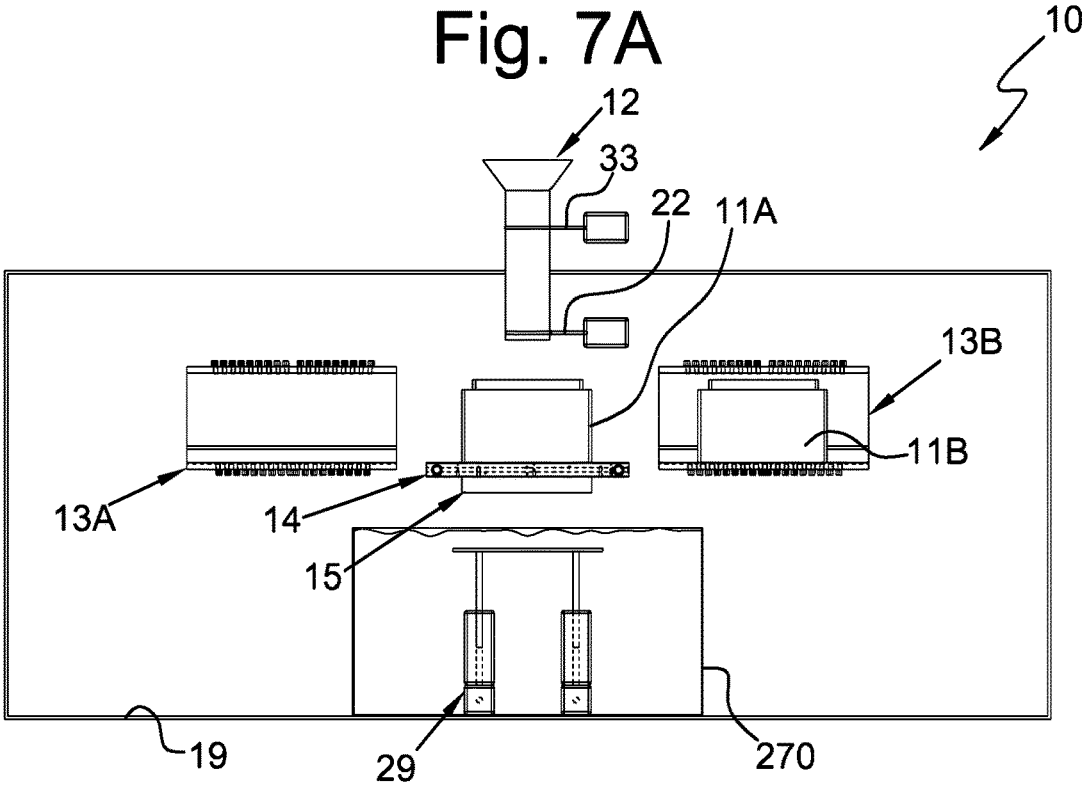
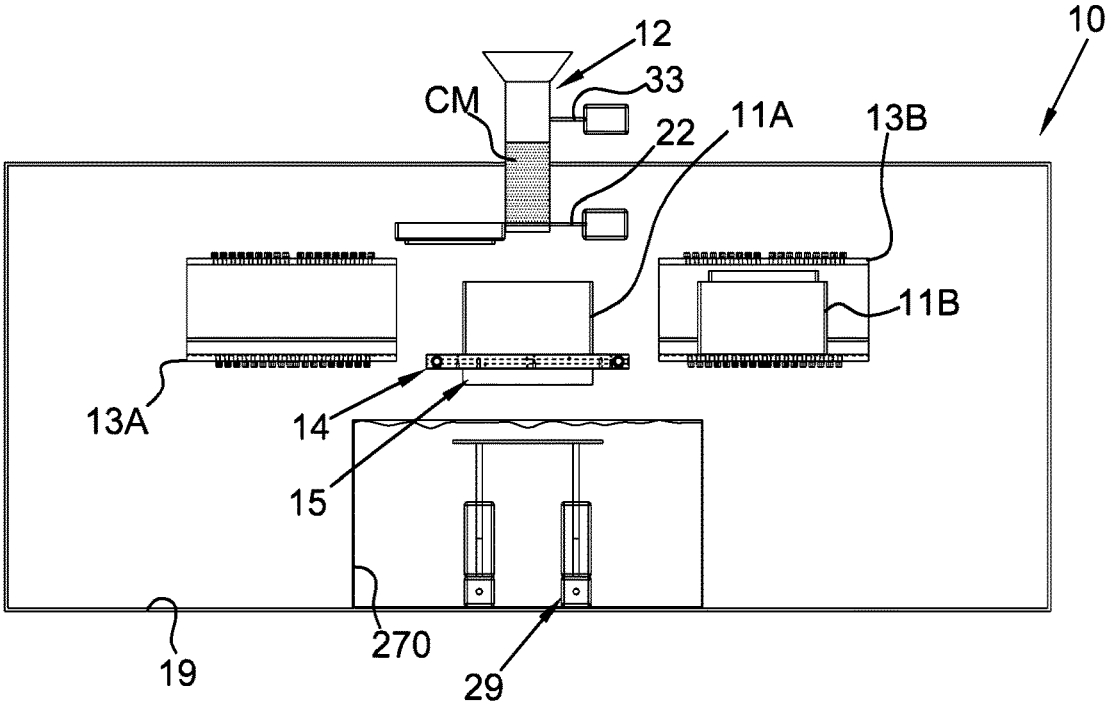
Fig. 7B

Fig. 7C
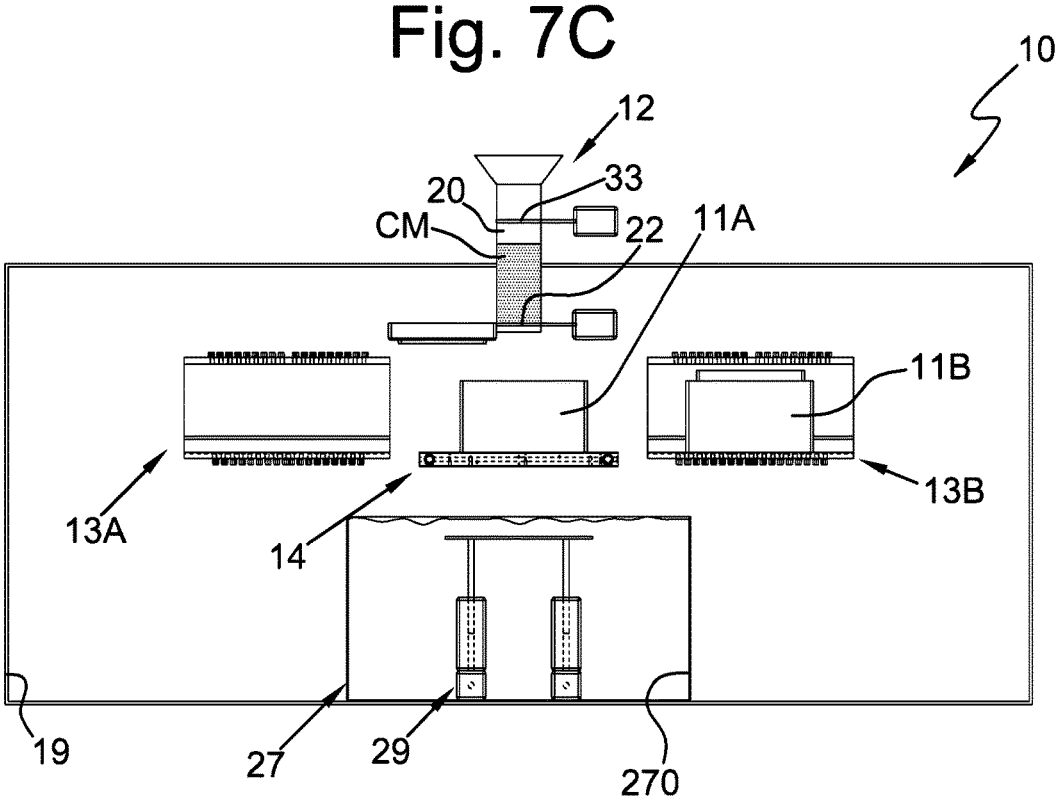
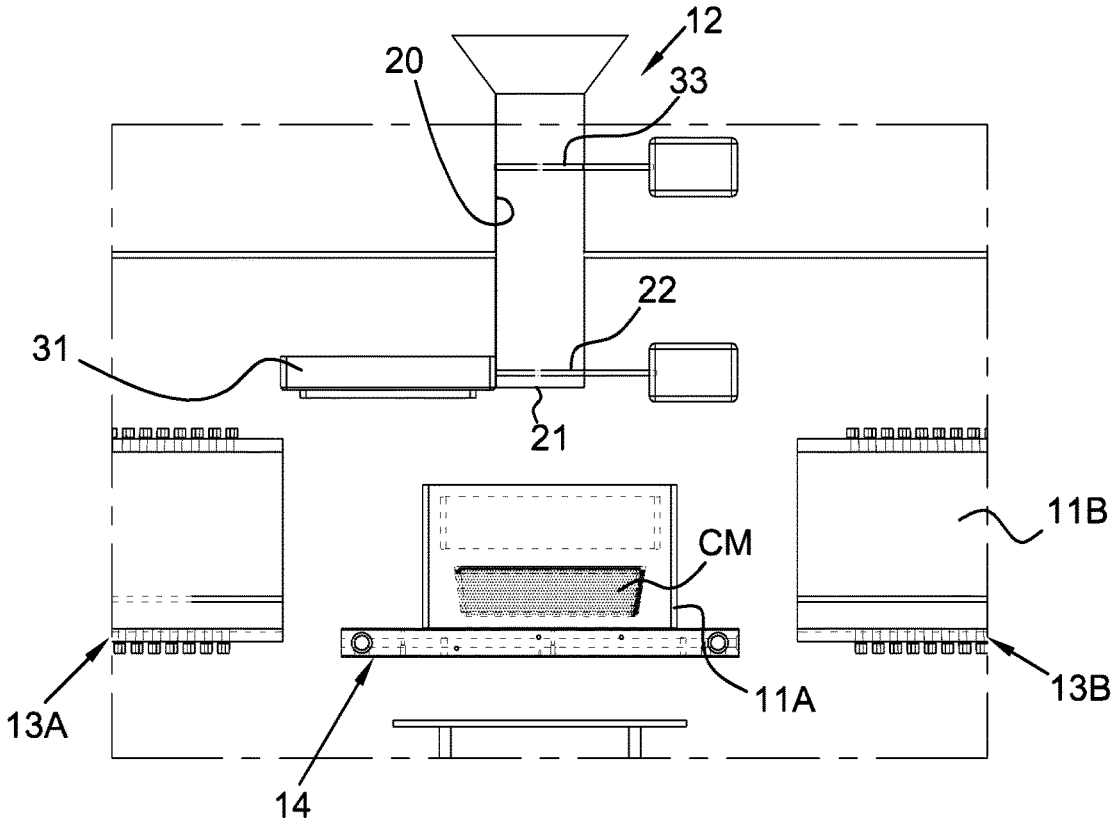
Fig. 7D

Fig. 7E
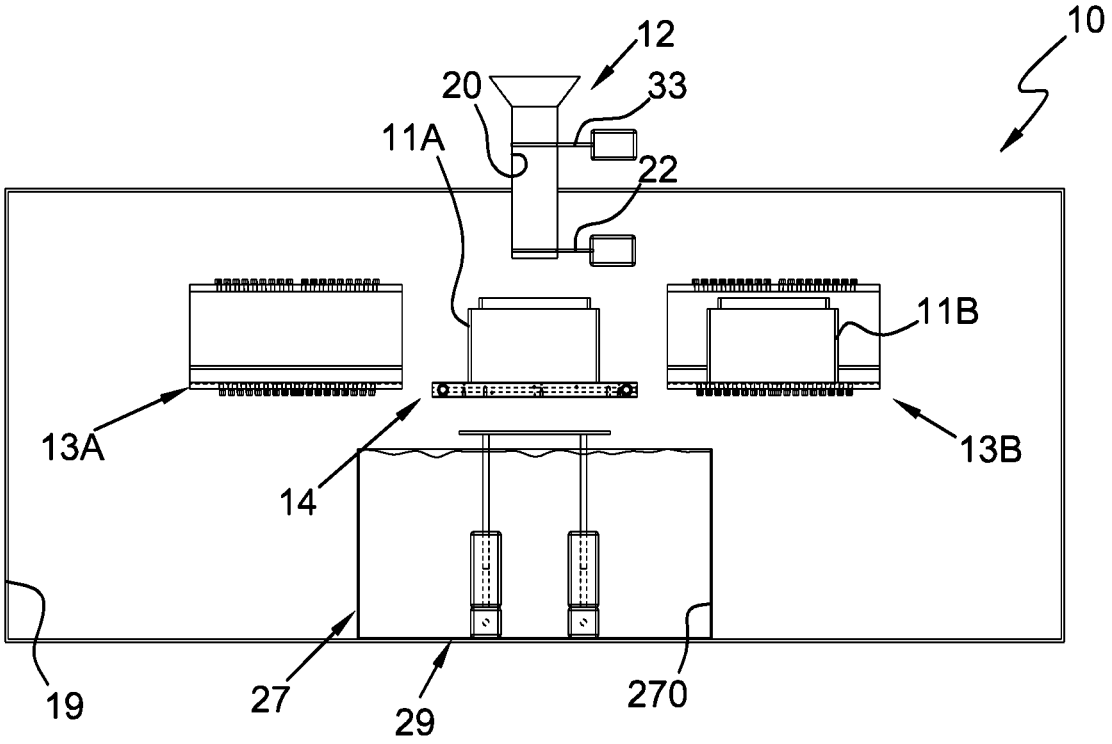
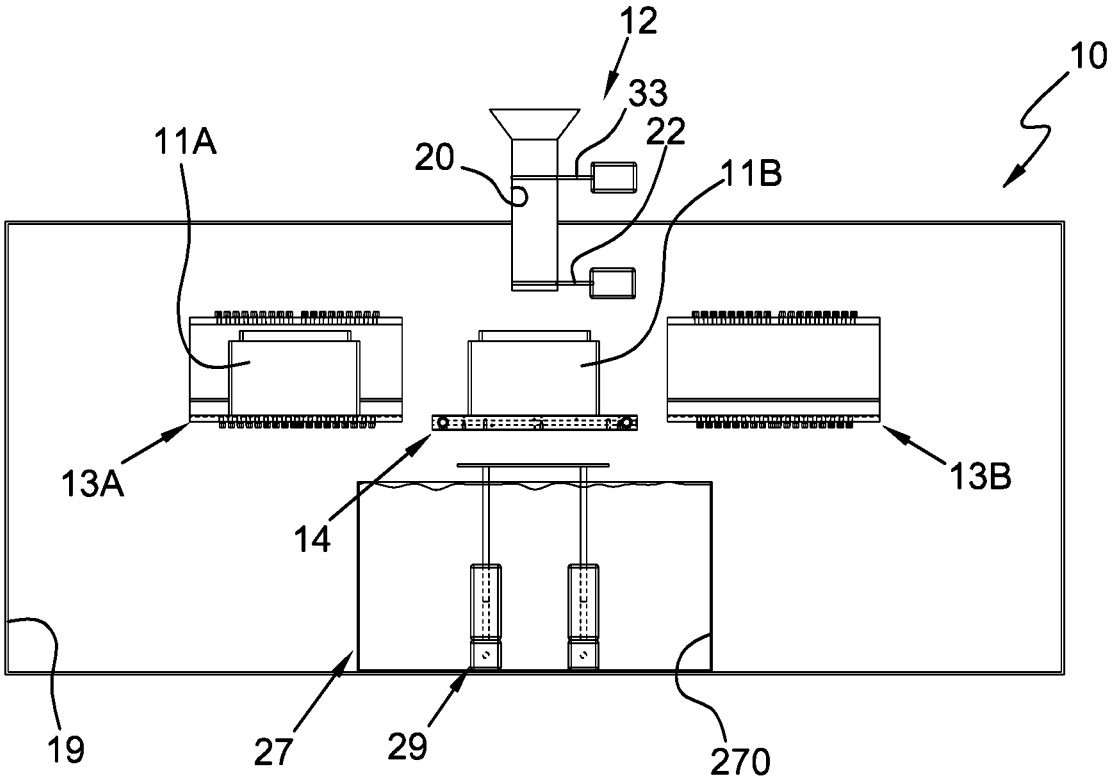
Fig. 7F

Fig. 7G
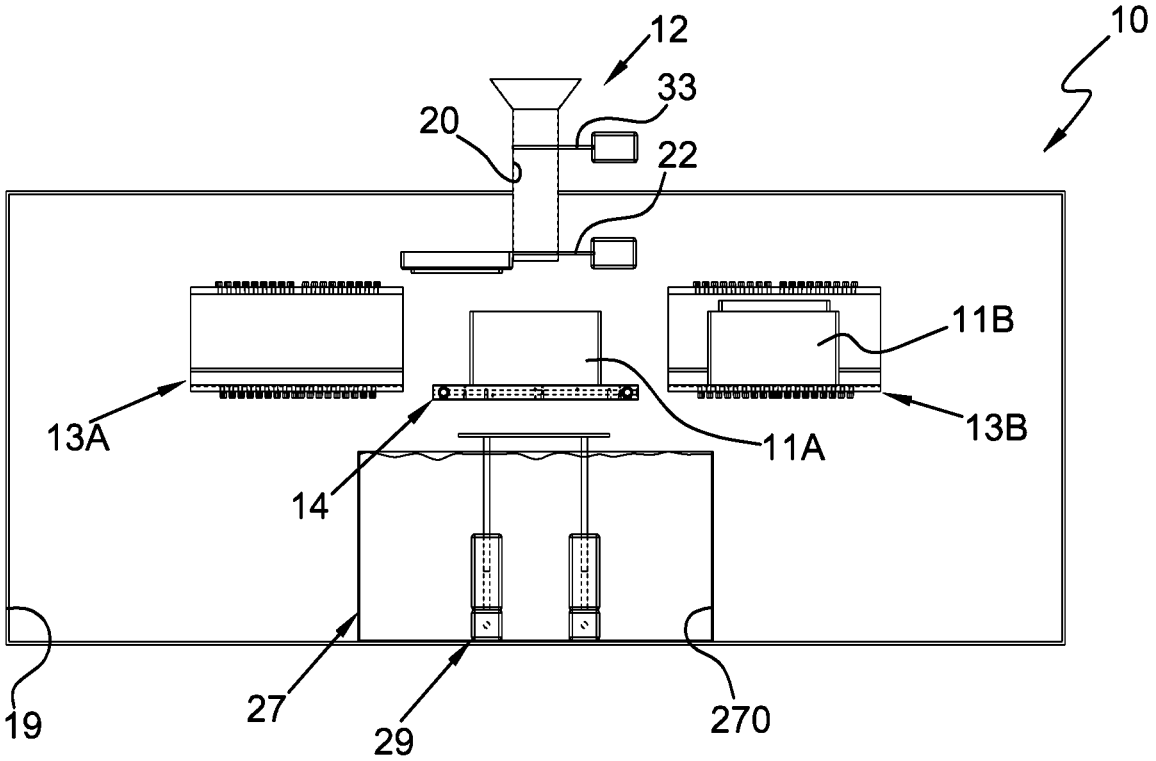
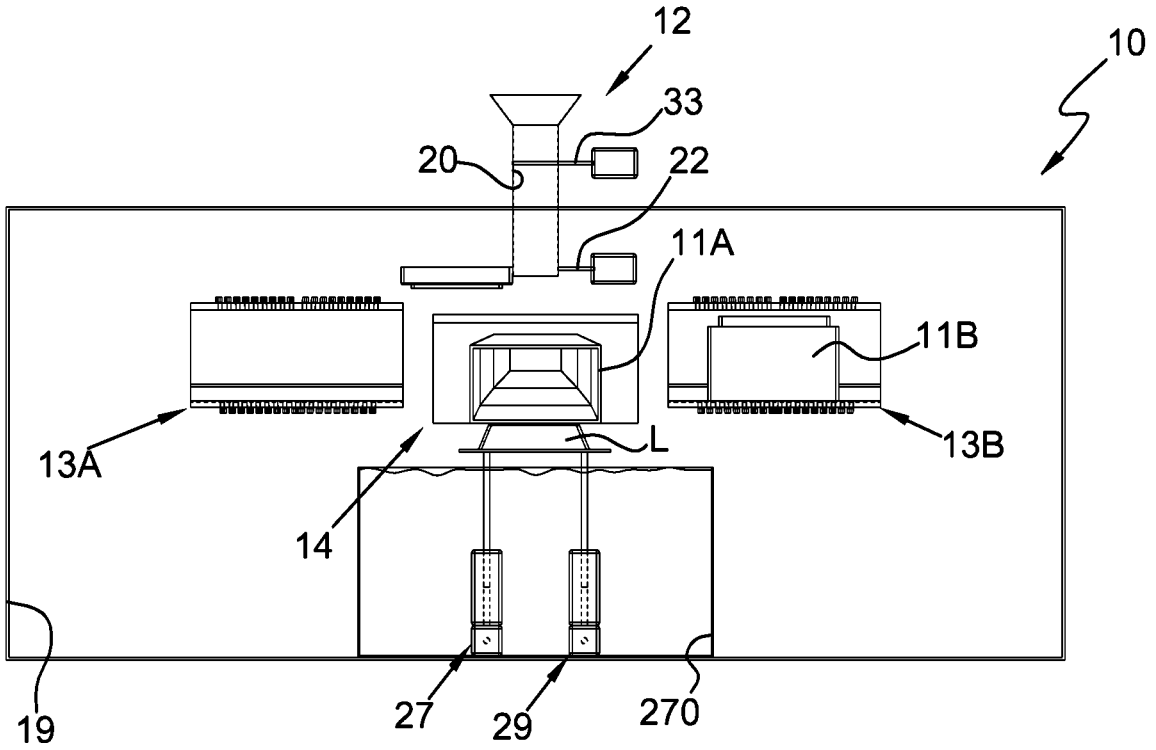
Fig. 7H

Fig. 7I
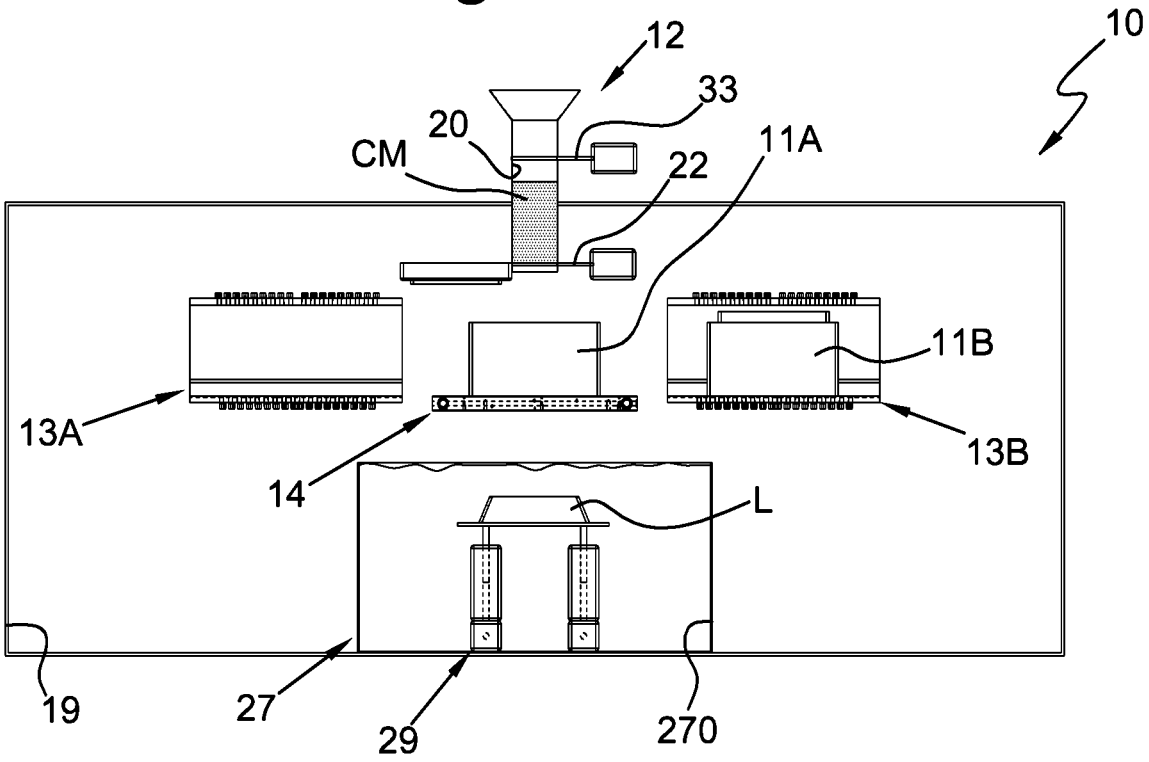
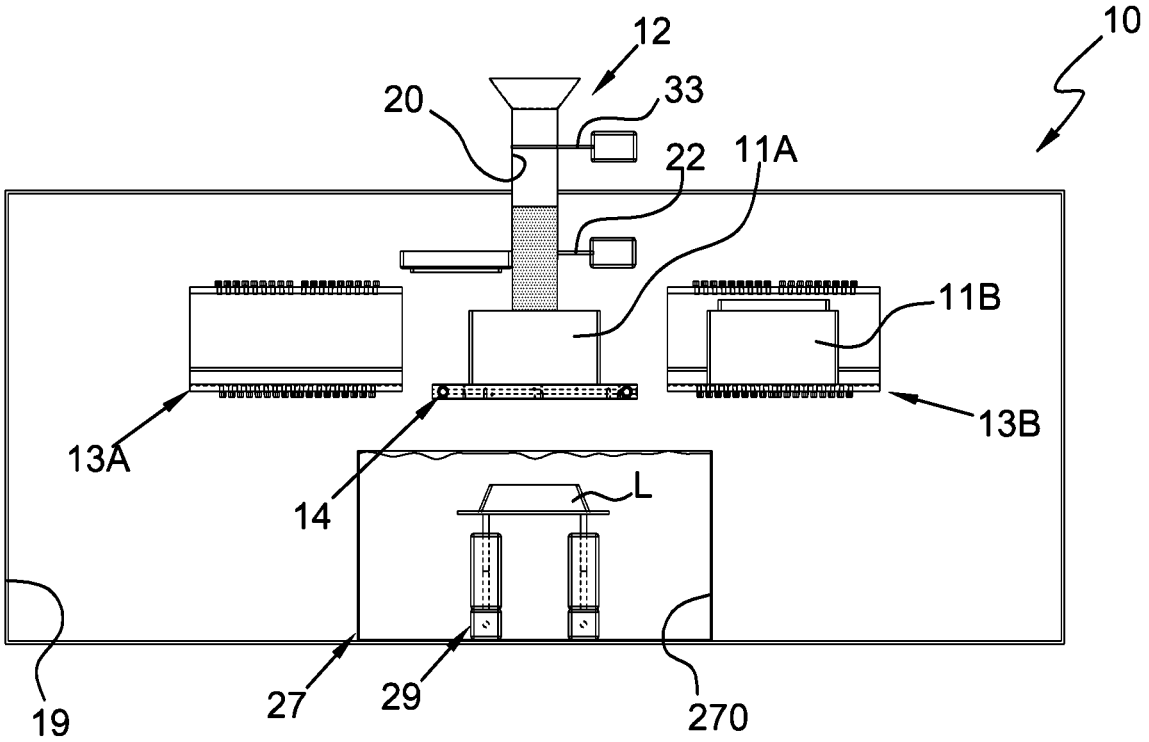
Fig. 7L

Fig. 7M
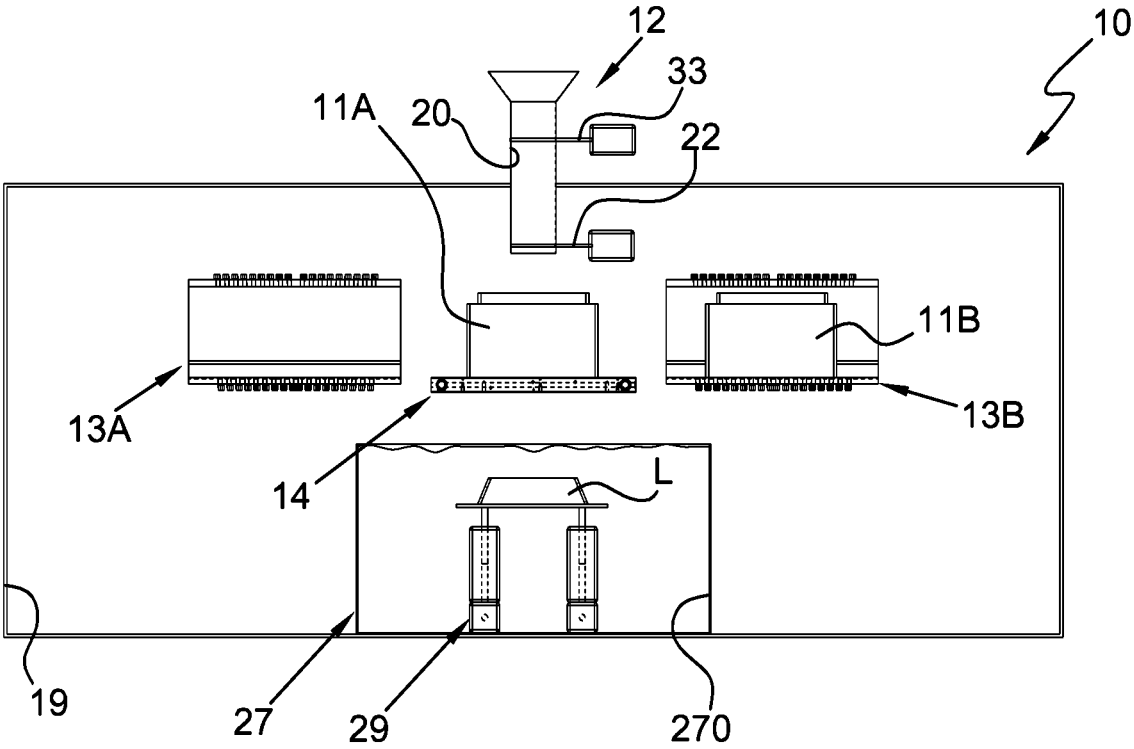
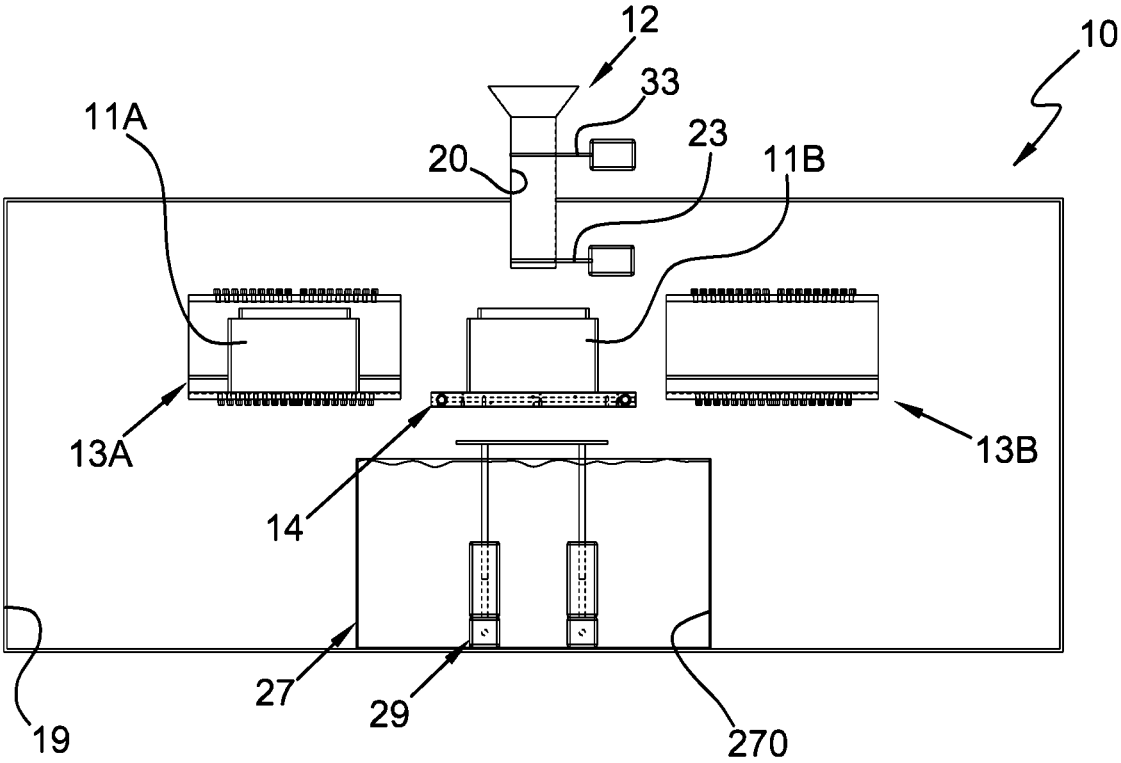
Fig. 7N

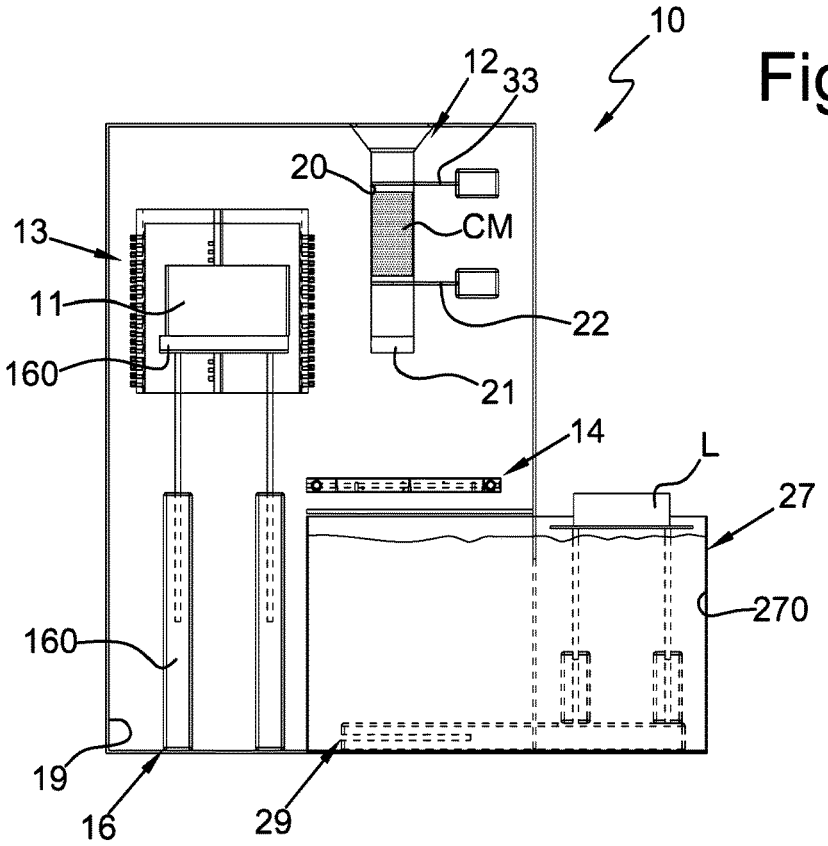
Fig. 10L
Fig. 11
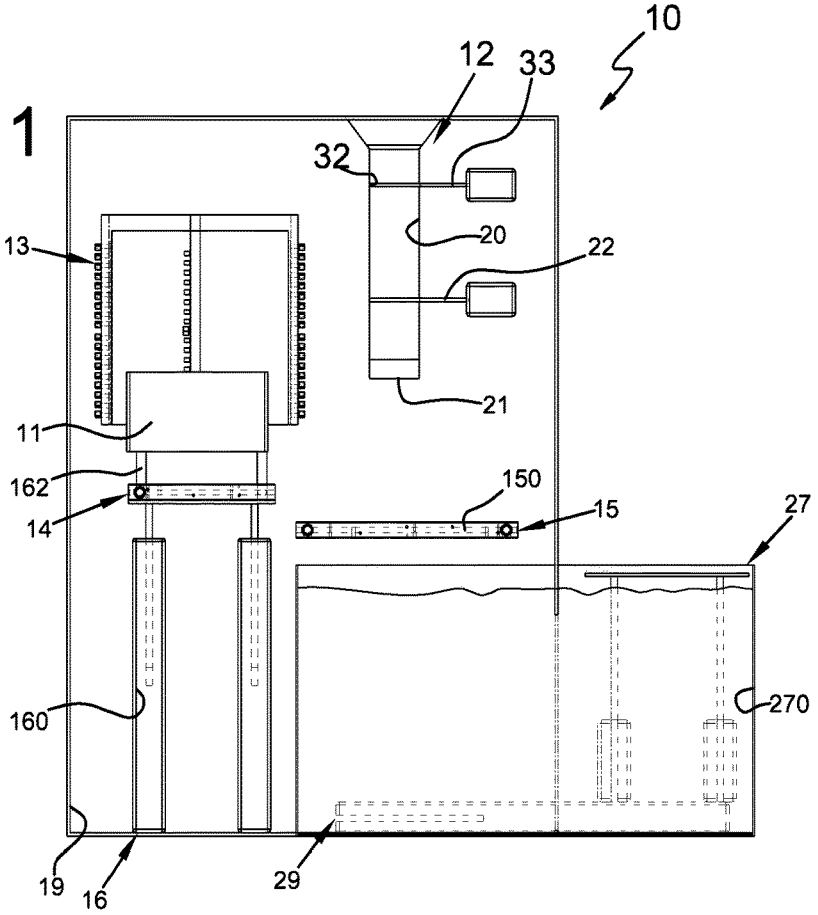

| Cycle start in normal conditions | Single step time (seconds) | Progressive time (seconds) |
|---|---|---|
| Opening of heating unit/cooling unit separating door | 5 sec | |
| Ingot mould translation from heating unit to cooling unit | 10 sec | 15 |
| Solidification step c) | 300 sec | 315 |
| Ingot mould lid opening | 5 sec | 320 |
| Ingot mould cooling unit/ingot cooling unit separating door opening | 5 sec | |
| Ingot mould overturning | 5 sec | 325 |
| Ingot mould Turning up | 5 sec | 330 |
| Positioning (descent) of filling unit | 5 sec | 335 |
| Filling unit dosing chamber discharge port opening | 5 sec | 340 |
| Metal charge discharge in to ingot mould | 5 sec | 345 |
| Filling unit dosing chamber discharge port closing | 5 sec | 350 |
| Filling unit dosing chamber feeding port opening | 5 sec | 355 |
| Filling unit dosing chamber metal charge feeding | 30 sec | |
| Filling unit dosing chamber feeding port closing | 5 sec | |
| Degasification treatment and inert gas insertion in the filling unit dosing chamber | 15 sec | |
| Ingot mould lid closing | 5 sec | |
| Ingot removal unit support plane descent | 5 sec | |
| Ingot mould cooling unit/ingot cooling unit separating door closing | 5 sec | |
| Ingot water cooling | 120 sec | |
| Removal of the ingot to the unloading area | 30 sec | |
| Translation of ingot mould from cooling unit to heating unit | 10 sec | 365 |
| Melting step b) | 540 sec | 905 |
| Heating unit/cooling unit separating door closing | 5 sec | |

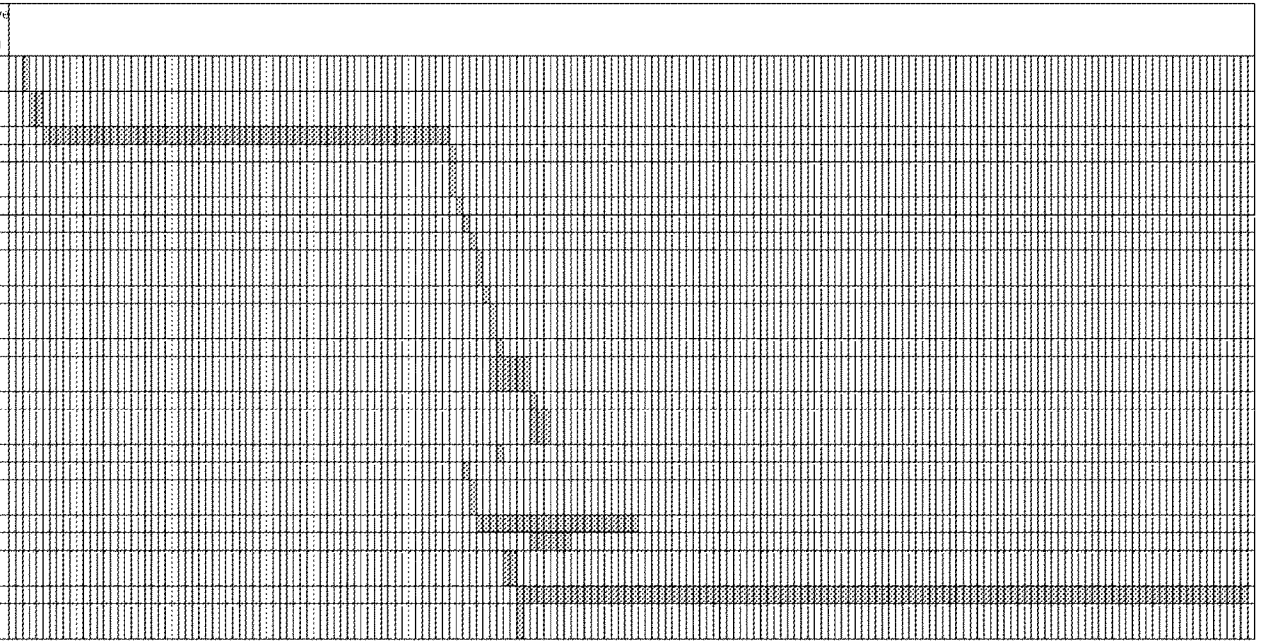

Fig. 13

PROCESS AND APPARATUS FOR PRODUCING METAL INGOTS

The present invention relates to a process for producing metal ingots and to an apparatus for producing metal ingots according to said process.

The present invention relates in particular to a process and an apparatus for producing metal ingots by melting.

The present invention relates in particular to a process and an apparatus for producing metal ingots of precious and non-precious metals or alloys thereof, where by precious metals it is meant metals selected from the group comprising at least: gold, silver, copper, platinum and palladium, pure or of known purity degrees/titres, while by non-precious metals it is meant non-ferrous metals including, for example, copper, aluminium and others.

Such metal ingots are generally marketed with weights ranging from 50 g to 1 kg or, in particular in the case of bank metal ingots, with weights equal to 400 oz or 1000 oz (where 1 oz=about 31.104 gr, the reference ounce "oz." being the Troy ounce) or even with intermediate weights between 1 kg and 1000 oz.

Metal ingots having such a weight are generally produced by melting a solid metal charge (mass) and then solidifying the molten metal charge into suitable moulds known as "ingot moulds".

The processes for producing metal ingots by melting and solidification of known type are divided into two main categories:

"Melting and pouring" production processes;

Production processes in which the metal charge in the solid state is melted directly into the ingot mould, in which the solidification takes place.

In the "melting and pouring" production processes, the solid state metal charge is fed into crucibles or ladles, which are heated to temperatures above the melting temperature of the metal charge. When the metal charge is completely melted, it is poured (cast) into the ingot moulds where it cools and solidifies into respective ingots and a new metal charge is fed into the crucibles or ladles. In the "melting and pouring" production processes, the crucibles or ladles, therefore, are kept at temperatures close to the melting temperature of the metal charge, the solidification and cooling of the ingots occurring in the moulds.

Although such "melting and pouring" production processes are advantageous in terms of energy expenditure, they exhibit some drawbacks, among which, in particular, the fact that the pouring operations entail losses of metal with consequent economic losses.

Another drawback consists in that the implementation of the process requires particular safety measures to safeguard the operators' safety.

The known production processes, in which the metal charge in the solid state is melted directly in the ingot mould in which the solidification takes place, are of two types:

tunnel type, wherein a plurality of process stations follow one another along a horizontal development production line;

static type with a single vertical development process station.

The tunnel-type processes comprise a plurality of units or stations successively crossed by a plurality of ingot moulds or train of ingot moulds: a station for loading the moulds each with a metal charge in the solid state (generally in the form of powders, particles, granules or fragments of various sizes), a melting station of the metal charge loaded in each mould, a solidification station of the molten metal charge in each mould until a respective ingot is obtained, a cooling station of the moulds each containing a respective ingot, an unloading station of the moulds with extraction of the respective ingot from each of them.

Processes of this type are generally carried out in continuous plants which may be provided with tunnel furnaces, along which the melting station, the solidification station and possibly the cooling station follow one another. Examples of such installations are described in documents IT1293022, IT1405105 (EP2694234) on behalf of the same proprietor and IT 1420976 (EP3077139) on behalf of TERA AUTOMATION.

Static-type processes provide for a single station with vertical development in which the melting, solidification and cooling steps are carried out.

One or more ingot moulds, each previously loaded with a solid metal charge (generally in the form of powders, particles, granules or fragments of various sizes), are inserted in this single station where they stay during the execution of the melting, solidification and cooling steps.

In the latter processes and plants of known type, after solidification of the molten metal charge, the moulds are cooled to reach the ambient temperature which, under standard conditions, is generally of the order of 20°-25° C. and in any case not higher than 50° C., having to allow the subsequent handling of the moulds (handling which is generally performed manually by operators) for the recirculation of the moulds themselves at the entrance of the plant for the continuous running of the production process.

Compared to the processes and plants of the "melting and pouring" type, these last known processes and plants have made it possible to eliminate any metal losses and to guarantee higher safety for the operators, having eliminated the pouring or casting step.

They have also allowed higher control of the individual production steps to obtain ingots that meet the quality requirements set by the industry standards and regulations (such as the standards set by the LBMA—The London Bullion Market Association) in terms not only of purity and control of the chemical composition, but also of the shape, dimensions, metallographic and surface structure of the ingots.

However, the latter processes and plants of a known type are economically disadvantageous in terms of energy consumption compared to the known processes and plants of the "melting and pouring" type, since it is necessary for each cycle to heat the moulds starting from the ambient temperature until they reach temperatures higher than the melting temperature of the metal charge, with consequent high energy absorption.

Moreover, these latter processes and plants of a known type, despite being conducted continuously, have limits in terms of production efficiency; limits that are due to the time duration of each production cycle, which requires the heating of the moulds starting from the ambient temperature and their subsequent cooling to ambient temperature.

It is also noted that these processes and plants of a known type, in particular those of the tunnel type, generally require the use of a train consisting of a plurality of ingot moulds, generally not less than six, in order to ensure a certain degree of continuity of production, with consequent investment costs.

Finally, it is noted that these plants of known type, in particular those of the tunnel type, have large dimensions and require large installation space.

The purpose of the present invention is to provide a process for producing metal ingots and an apparatus for producing metal ingots implementing such a process, a process and an apparatus of the type in which the metal charge in the solid state is melted directly into the moulds in which the solidification takes place, which overcome the drawbacks of the prior art.

Within this general purpose, a particular purpose of the present invention is to provide a process for producing metal ingots and an apparatus for producing metal ingots implementing such a process which allow reducing the overall energy consumption compared to the processes and plants of known type (in particular of the tunnel type and/or of the static type with a single station) in which the metal charge in the solid state is melted directly into the moulds in which the solidification then takes place.

Another purpose of the present invention is to provide a process for producing metal ingots and an apparatus for producing metal ingots implementing such a process which allows increasing the production efficiency compared to processes and plants of a known type (in particular of the tunnel type and/or static with a single station) in which the metal charge in the solid state is melted directly into the moulds in which the solidification then takes place.

Another purpose of the present invention is to provide a process for producing metal ingots and an apparatus for producing metal ingots implementing such a process which allows obtaining high quality ingots meeting the requirements imposed by the industry standards and regulations.

Another purpose of the present invention is to provide an apparatus for producing metal ingots which is particularly simple and functional, with reduced overall dimensions and cost-effective.

These purposes and others which will become apparent from the following description are achieved by a process for producing metal ingots as set forth in claim 1.

These purposes and others which will become apparent from the following description are achieved by an apparatus for producing metal ingots as set forth in claim 11.

Further characteristics are described in the dependent claims.

According to a first aspect of the present invention, a process is provided for producing metal ingots comprising at least the following steps:

a) filling an ingot mould with a metal charge in the solid state for the formation of a respective ingot, wherein said metal charge has a melting temperature $T_f$ that is higher than ambient temperature $T_a$, b) melting said metal charge in the solid state by heating an ingot mould filled with a metal charge in the solid state up to a heating temperature $T_{rs}$ that is higher than or equal to the melting temperature $T_f$ of said metal charge until the metal charge melts, c) solidifying or letting solidify said metal charge into a respective ingot by cooling or letting cool said ingot mould containing said molten metal charge to a cooling temperature $T_{rf}$ that is lower than said melting temperature $T_f$ and higher than ambient temperature $T_a$ until said molten metal charge is solidified into said respective ingot, d) extracting said ingot from said ingot mould, e) reiterating said steps from a) to d), wherein, at steady state, said extracting d) and filling a) steps are carried out when said ingot mould is respectively at an extraction temperature $T_e$ and at a filling temperature $T_{rp}$ each of which is lower than or equal to said cooling temperature $T_{rf}$ and higher than said ambient temperature $T_a$.

By ambient temperature $T_a$ it is meant, in general, a standard reference temperature of the order of 20°-25° C. and, considering the specific sector, generally not higher than 50° C.

The process according to the present invention is of the type in which the metal charge in the solid state is melted directly into the ingot moulds in which the subsequent solidification of the molten metal charge with formation of at least one respective ingot takes place.

By metal charge in the solid state it is meant a mass formed by powders, particles, granules, fragments and the like of metal material.

By metal material it is meant, in particular, a metal material selected from the group comprising precious and non-precious metals and alloys thereof.

By precious metals it is meant a metal selected from the group comprising at least: gold, silver, platinum and palladium, either pure or alloyed, with known purity degrees/titres.

By non-precious metals it is meant a metal selected from the group comprising at least: copper, aluminium and others, either pure or alloyed, with known purity degrees/titres.

The present invention, in particular, does not relate to the production of ingots of metal materials which have a melting temperature lower than 500° C.

According to the literature, each of the above listed precious metals considered in the pure state has a melting temperature $T_f$ that is significantly higher than the ambient temperature $T_a$:

pure gold has a melting temperature $T_f$ of 1063° C.;
pure silver has a melting temperature $T_f$ of 961° C.;
pure platinum has a melting temperature $T_f$ of 1773° C.;
pure palladium has a melting temperature $T_f$ of 1555° C.

As regards, instead, the above listed non-precious (non-ferrous) metals considered in their pure state, based on the data reported in the literature:

pure copper has a melting temperature $T_f$ of 1083° C.;
pure aluminium has a melting temperature $T_f$ of about 660° C.

The metal charge in the solid state is at a temperature substantially equal to the ambient temperature $T_a$ when it is loaded in the at least one ingot mould.

With the exception of the first start-up cycle, during the loading step a) of each production cycle, at steady state, the at least one ingot mould is instead at a filling temperature $T_{rp}$ higher than the ambient temperature $T_a$. At steady state conditions, that is to say, the solid state metal charge is introduced into the at least one ingot mould when the latter is still "hot", having a temperature (filling temperature $T_{rp}$) advantageously close to the cooling temperature $T_{rf}$ at which the solidification step has been carried out.

The melting step b) takes place by heating the at least one ingot mould filled with the at least one metal charge in the solid state up to a heating temperature $T_{rs}$ that is higher than or equal to the melting temperature $T_f$ of the metal charge until the metal charge melts completely.

Generally, the heating temperature $T_{rs}$ is higher than at least 50° C. with respect to the melting temperature $T_f$; the heating temperature $T_{rs}$ is preferably higher than at least 100° C. and no more than 400° C. with respect to the melting temperature $T_f$ ($T_f \leq T_{rs} \leq (T_f + 400°\ C.)$), even more preferably no more than 200° C. ($T_f \leq T_{rs} \leq (T_f + 200°\ C.)$).

Depending on the type of impurities possibly present in the metal charge, in fact, it is generally necessary to heat the ingot mould to a heating temperature $T_{rs}$ higher than the melting temperature $T_f$ by about 50-200° C. in order to correctly homogenize the melted metallic bath.

The melting step b) may be carried out using any heating unit of known type, such as for example burner type, electric resistors or induction heating elements.

The solidification step c) consists in solidifying or letting solidify the molten metal charge with the formation of a respective ingot, cooling or letting cool the at least one ingot mould containing the respective molten metal charge to a cooling temperature $T_{rf}$ lower than the melting temperature $T_f$ and higher than the ambient temperature $T_a$ until the solidification of the molten metal charge is complete ($T_a<T_{rf}<T_f$).

The cooling temperature $T_{rf}$ is lower than the melting temperature $T_f$ by at least 50° C., preferably by at least 100° C. ($T_a<T_{rf}\leq(T_f-100°$ C.)

In the case of metal charges with melting temperature $T_f$ higher than 600°-700° C., the cooling temperature $T_{rf}$ is lower than the melting temperature $T_f$ and higher than or equal to 400° C., preferably higher than or equal to 500° C. (400° C.$\leq T_{rf}<T_f$; 400° C.$\leq T_{rf}<(T_f-100°$ C.)).

The solidification step c) is carried out with known systems; in particular, it may be carried out by allowing the at least one ingot mould cool naturally or by using cooling units of the type, for example, with plates variously shaped and cooled by circulation of a cooling fluid such as for example described in IT1405105 (EP2694234) on behalf of the same proprietor.

According to the present invention, the extraction step d) and the filling step a) are conducted when the at least one mould is respectively at an extraction temperature $T_e$ and at a filling temperature $T_{rp}$ each of which is less than or equal to the cooling temperature $T_{rf}$ (the one at which the ingot mould is for the conduction of the solidification step c)) and is higher than the ambient temperature $T_a$ ($T_a<T_e\leq T_{rf}$; $T_a<T_{rp}\leq T_{rf}$).

According to the present invention, therefore, after the solidification step c), the production process does not provide for any cooling step of the at least one ingot mould to ambient temperature $T_a$.

The extraction step d) is carried out as soon as the solidification step c) has taken place and the filling step a) is carried out as soon as the extraction step d) has taken place.

According to the present invention, at each step of the process, including the extraction d) and filling a) steps, the at least one mould is always at a temperature higher than the ambient temperature T, so as to reduce the time and energy consumption to return the at least one ingot mould to the heating temperature $T_{rs}$.

By how many degrees the temperature of the at least one ingot mould and, in particular the extraction temperature $T_e$ thereof and the filling temperature $T_{rp}$ thereof, is higher than the ambient temperature $T_a$ depends, among other things, on the treated metal material (in particular, the melting temperature $T_f$ thereof and, therefore, the cooling temperature $T_{rf}$ to which it is necessary to bring the at least one mould for the complete solidification of the molten metal charge), as well as on the time and conditions of execution of the extraction step d) and of the filling step a).

Advantageously, according to the present invention, the extraction d) and filling a) steps are carried out when the at least one mould is respectively at an extraction temperature $T_e$ and at a filling temperature $T_{rp}$ substantially equal to each other, with variations within the range of about 50-100° C.

Advantageously, according to the present invention the extraction d) and filling a) steps are conducted when the at least one mould is respectively at an extraction temperature $T_e$ and at a filling temperature $T_{rp}$, each of which is substantially equal to the cooling temperature $T_{rf}$, i.e. equal to the cooling temperature $T_{rf}$ less the reduction that the temperature of the ingot mould naturally undergoes during the time necessary for the execution of the extraction steps d) and of the filling step a) as soon as the solidification step c) is completed.

Such a reduction (i.e. the reduction of the temperature of the ingot mould between the solidification step c) and the extraction d) and filling a) steps) is advantageously lower than 150°-200° C., preferably lower than 100° C., even more preferably lower than 50° C.):

($T_{rf}-200°$)$\leq T_e\leq T_{rf}$ and ($T_{rf}-200°$)$\leq T_{rp}\leq T_{rf}$;

preferably ($T_{rf}-150°$)$\leq T_e\leq T_{rf}$ and ($T_{rf}-150°$)$\leq T_{rp}\leq$Trf;

even more preferably ($T_{rf}-50°$)$\leq T_e\leq T_{rf}$ and ($T_{rf}-50°$) $\leq T_{rp}\leq T_{rf}$.

This is obtained, for example, by carrying out the extraction step d) in a time not exceeding 60 seconds, preferably less than 30 seconds, after the solidification step c) and carrying out the filling step a) in a time not exceeding 60 sec, preferably less than 30 sec, after the extraction step d).

Considering metallic charges with melting temperature $T_f$ higher than 600°-700° C., such as for example in the case of metal charges of precious metals or non-precious metals of the non-ferrous type, pure or alloys thereof, as indicated above, the cooling temperature $T_{rf}$ of the at least one ingot mould is lower than the melting temperature $T_f$ and higher than or equal to 400° C., preferably higher than or equal to 500° C., (400° C.$\leq T_{rf}\leq T_f$) and the extraction d) and filling a) steps are conducted when the at least one mould is respectively at an extraction temperature $T_e$ and at a filling temperature $T_{rp}$, each of which is lower than or equal to the cooling temperature $T_{rf}$ and higher than or equal to 400° C., preferably higher than or equal to 500° C., of course as a function of the cooling temperature $T_{rf}$ set (400° C.$\leq T_e\leq T_{rf}$; 400° C.$\leq T_{rp}\leq T_{rf}$).

Advantageously, considering metal charges of precious metals or non-precious metals of the non-ferrous type, pure or alloys thereof, as indicated above, the cooling temperature $T_{rf}$ is lower than the melting temperature $T_f$ by no more than 300° C., even more preferably it is lower than the melting temperature $T_f$ by no more than 200° C.

In this case, each of the extraction temperatures $T_e$ and of the filling temperature $T_{rp}$ is lower than or equal to the cooling temperature $T_{rf}$ and higher than or equal to 400° C., preferably higher than or equal to 500° C.; even more preferably each of the extraction temperatures $T_e$ and of the filling temperature $T_{rp}$ is lower than the cooling temperature $T_{rf}$ by no more than 150°-200° C., preferably not more than 100°-150° C. and even more preferably not more than 50°-100° C.

In fact, the higher the extraction temperature $T_e$ and, in particular, the filling temperature $T_{rp}$, the higher the energy savings achieved during the melting step b) of the subsequent production cycle and the relative execution times.

In the case, for example, of a metal charge consisting of pure silver, the melting temperature $T_f$ whereof is equal to about 961° C.:

the melting step b) is carried out by bringing the ingot mould to a heating temperature $T_{rs}$ in the range of 1050° C.-1250° C., the solidification step c) is carried out by bringing the ingot mould to a cooling temperature $T_{rf}$ in the range from 700° C. to 900° C., preferably in the range of 750°-850° C., and the extraction steps d) and the filling steps a) are conducted when the ingot mould is respectively at an extraction temperature $T_e$ and at a filling temperature $T_{rp}$ each of which is less than or equal to the cooling temperature $T_{rf}$ and higher than or equal to 400° C., preferably higher than or equal to 500° C., even more preferably less than the cooling temperature $T_{rf}$ by no more than 150°-200° C., preferably not more than 100°-150° C., even more preferably not more than 50°-100° C. and therefore within the range of 400° C.-850° C.

In the case, for example, of a metal charge consisting of pure gold, the melting temperature $T_f$ whereof is equal to about 1063° C.:

the melting step b) is carried out by bringing the ingot mould to a heating temperature $T_{rs}$ in the range of 1250° C.-1450° C., the solidification step c) is carried out by bringing the ingot mould to a cooling temperature $T_{rf}$ within the range of from 800° C. to 1000° C., preferably in the range of 850°-950° C. and even more preferably in the range of 900°-950° C., and the extraction steps d) and filling steps a) are conducted when the ingot mould is respectively at an extraction temperature $T_e$ and at a filling temperature $T_{rp}$ each of which is less than or equal to the cooling temperature $T_{rf}$ and higher than or equal to 400° C., preferably higher than or equal to 500° C., even more preferably less than the cooling temperature $T_{rf}$ by no more than 150°-200° C., preferably not more than 100°-150° C., even more preferably not more than 50°-100° C. and therefore in the range of 400° C.-950° C.

According to a further aspect of the present invention, each of the said steps from a) to d) is carried out in substantially inert atmosphere or in vacuum conditions.

By substantially inert atmosphere, it is meant a non-oxidizing atmosphere obtained with inert gases of the Argon or Nitrogen type, optionally admixed with percentages of some hydrogen units.

Not only the melting steps b) and the solidification steps c) are carried out in a substantially inert atmosphere or under vacuum conditions, but also the extraction d) and filling a) steps, in order to prevent oxidation phenomena of the ingot moulds, which are generally made of graphite, in particular when the extraction steps d) and of filling a) are carried out when the ingot mould is respectively at an extraction temperature $T_e$ and at a filling temperature $T_{rp}$ each of which is higher than 400°-500° C. (temperatures at which graphite oxidizes in air), as well as o limit any oxidation phenomena of the metal material forming the charge.

According to a further aspect of the present invention, therefore, the filling step a) is carried out under substantially inert atmosphere conditions or under vacuum conditions.

The filling step a) provides a pre-treatment or "washing" step of the solid state metal charge with an inert gas stream or with the generation of vacuum conditions before it is deposited in the ingot mould.

The extraction step d) is also carried out under substantially inert atmosphere conditions or under vacuum conditions.

The extraction step d) may take place, for example, by tilting the ingot mould or by withdrawing the ingot contained therein with the aid of manipulators.

The process according to the present invention further comprises a cooling step f) of the at least one ingot extracted from the at least one ingot mould up to ambient temperature $T_a$.

The cooling step f) of the ingots can take place, for example, by immersing the ingots in a tank containing a cooling fluid (water), by impinging the ingots with jets of a cooling liquid (water), by means of cooling plates in which a cooling fluid circulates, in air or other.

Advantageously, the cooling step f) takes place by immersing the ingots in a tank containing a cooling fluid (water) in which the ingots are directly immersed during the extraction step d). In this case, the cooling fluid (water) may be used as a barrier adapted to maintain a substantially inert atmosphere during the extraction step d).

According to a further aspect of the present invention, therefore, at least the steps a)-e) (i.e. filling, melting, solidification and extraction) are carried out in a closed chamber within which a substantially inert atmosphere or vacuum conditions is created and maintained.

The closed chamber may consist of a single space, inside which a substantially inert atmosphere or vacuum conditions are created and maintained, or of a plurality of spaces or compartments intercommunicating with each other or connected by means of protected paths (for example tunnel type) with the interposition of doors or protective barriers of movable or removable type, in which a substantially inert atmosphere or vacuum conditions are created and maintained within each chamber or compartment and each protected path.

Each chamber or compartment may be used for carrying out one or more of the process steps a)÷d) (i.e. filling, melting, solidification and extraction) and, optionally, the cooling step f) of the ingots.

Advantageously, the filling a) and solidification c) steps are carried out in the same space or compartment of the closed chamber.

Advantageously, the filling a), solidification c) and extraction d) steps are carried out in the same space or compartment of the closed chamber.

If the cooling step f) of the ingots takes place by immersing the ingots in a tank containing a cooling fluid (water), this tank is partially inserted in the closed chamber at the same space or compartment thereof in which the extraction step d) takes place or in a space or compartment thereof in communication with the latter, the cooling fluid (water) being used as a barrier to isolate the environment inside the closed chamber from the environment external thereto.

It is noted that, in the case in which at least the steps a)÷d) of the production process (i.e. filling, melting, solidification and extraction) are carried out in a closed chamber as defined above, the at least one ingot mould remains inside of such a closed chamber during the cyclic execution of the production process.

In this case, the production process will also include a removal step g) of the at least one ingot after the extraction step d) and before or after the cooling step f) of the ingots.

The removal step g) will also take place through a compartment in communication with the closed chamber and with the environment outside the closed chamber and provided with barrier means for isolating the atmosphere within the closed chamber from the atmosphere of the environment external to the closed chamber.

If the cooling step f) of the ingots takes place by immersing the ingots in a tank containing a cooling fluid (water), this same tank may be used as a space for the removal of the ingots from the closed chamber.

The features and the advantages of a process for producing metal ingots and of an apparatus for producing metal ingots for carrying out the process according to the present invention will become apparent from the following exemplary and non-limiting description, made with reference to the accompanying schematic drawings, in which:

FIG. 1 is a schematic partially sectional view of a first possible embodiment of the apparatus according to the present invention;

FIGS. 2A to 2H schematically show the apparatus of FIG. 1 in several successive operating steps for implementing the process according to the present invention;

FIG. 3 is a schematic partially sectional view of a second possible embodiment of the apparatus according to the present invention;

FIGS. 4A to 4C schematically show the apparatus of FIG. 3 in different successive operating steps for implementing the process according to the present invention;

FIGS. 5 and 6 are schematic partially sectional view, respectively in elevation and top plan, of a third possible embodiment of the apparatus according to the present invention;

FIGS. 7A to 7I and 7L to 7N schematically show the apparatus of FIGS. 5 and 6 in different successive operating steps for implementing the process according to the present invention;

Figure 1:
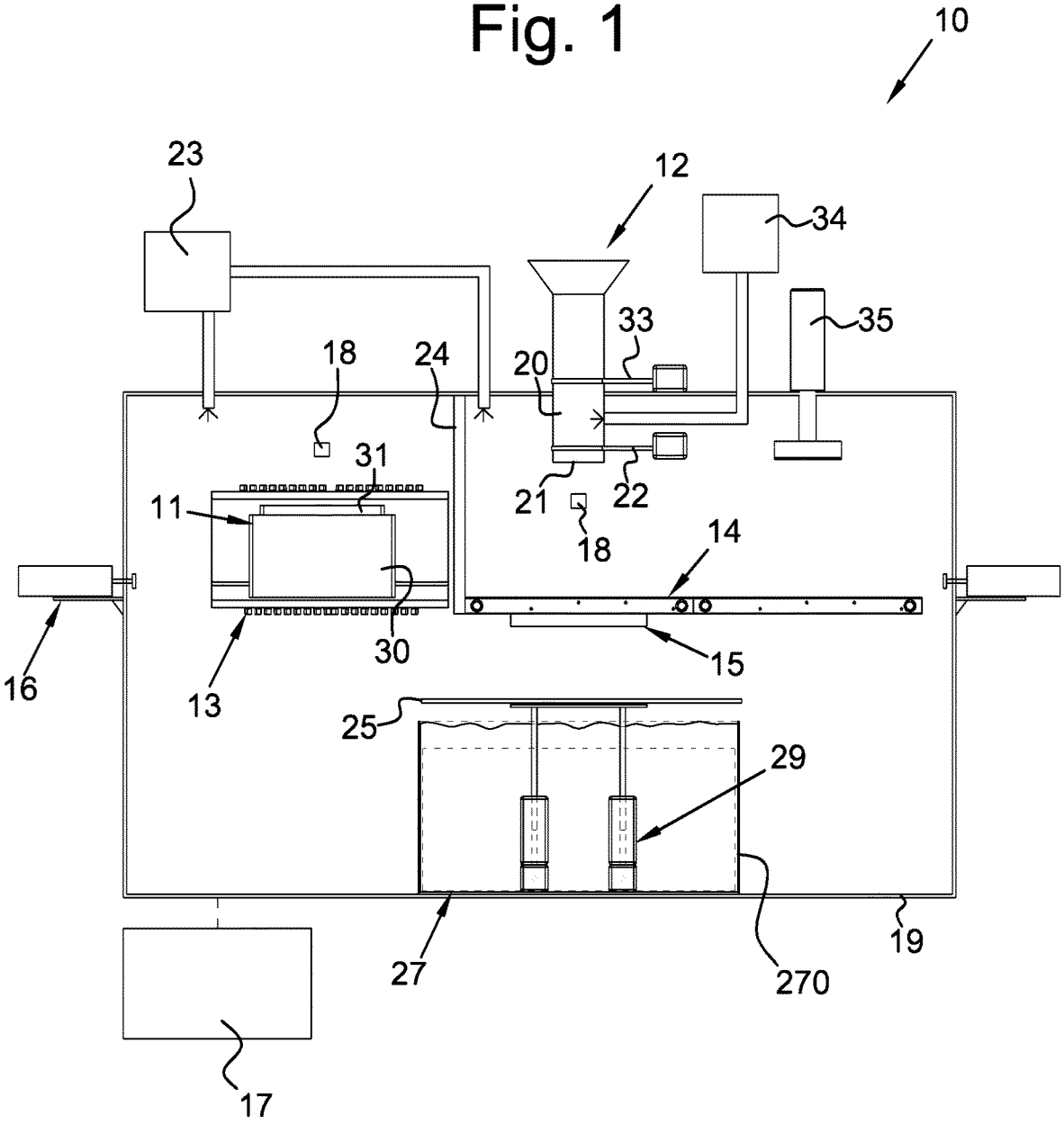
Figure 5:
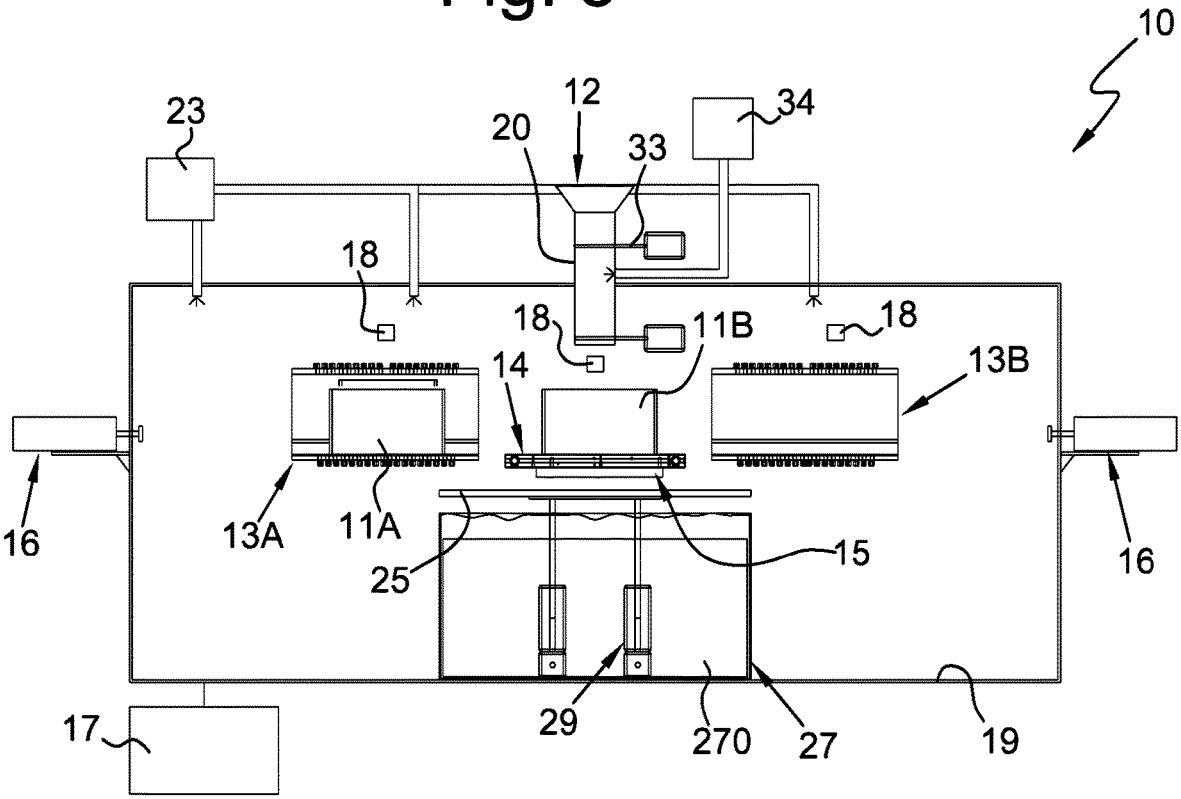
Figure 9:
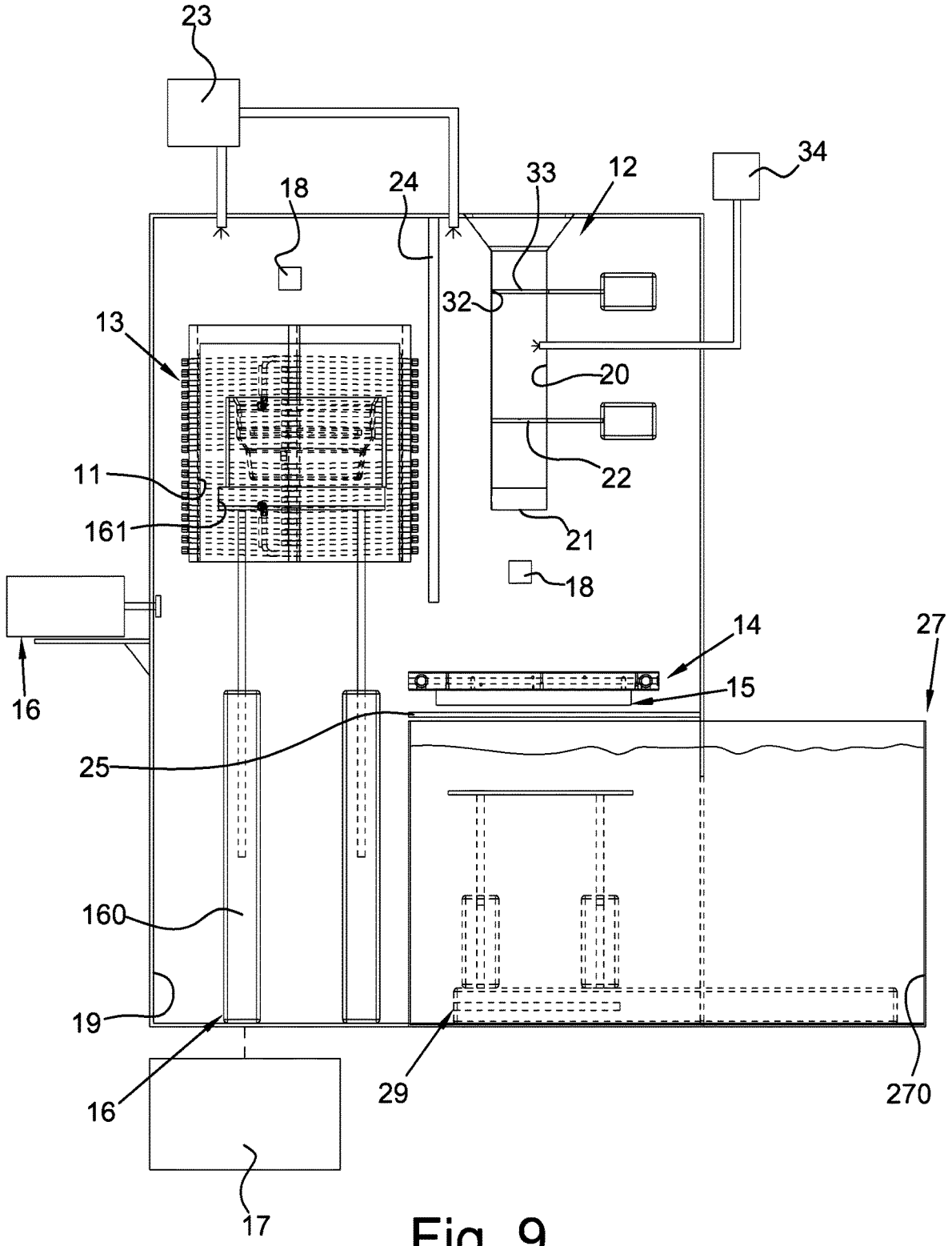
FIG. 9 is a schematic partially sectional view of a fourth possible embodiment of the apparatus according to the present invention.
Figure 10A:
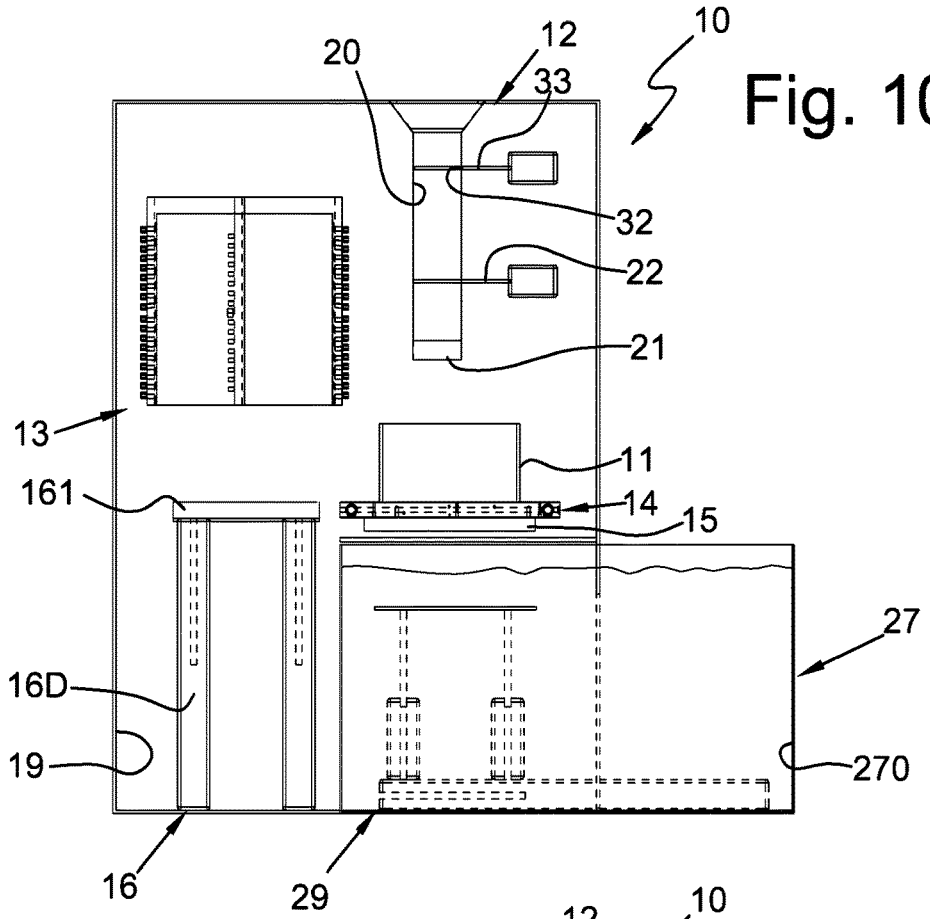
Figure 10B:
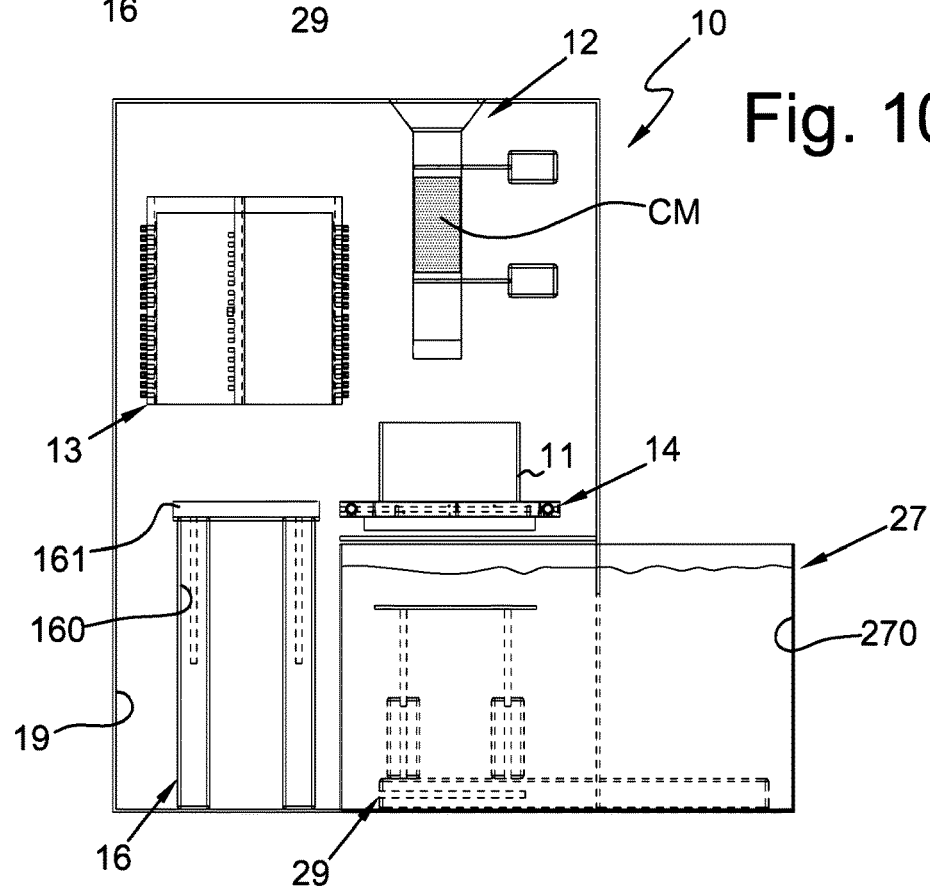
Figure 10C:
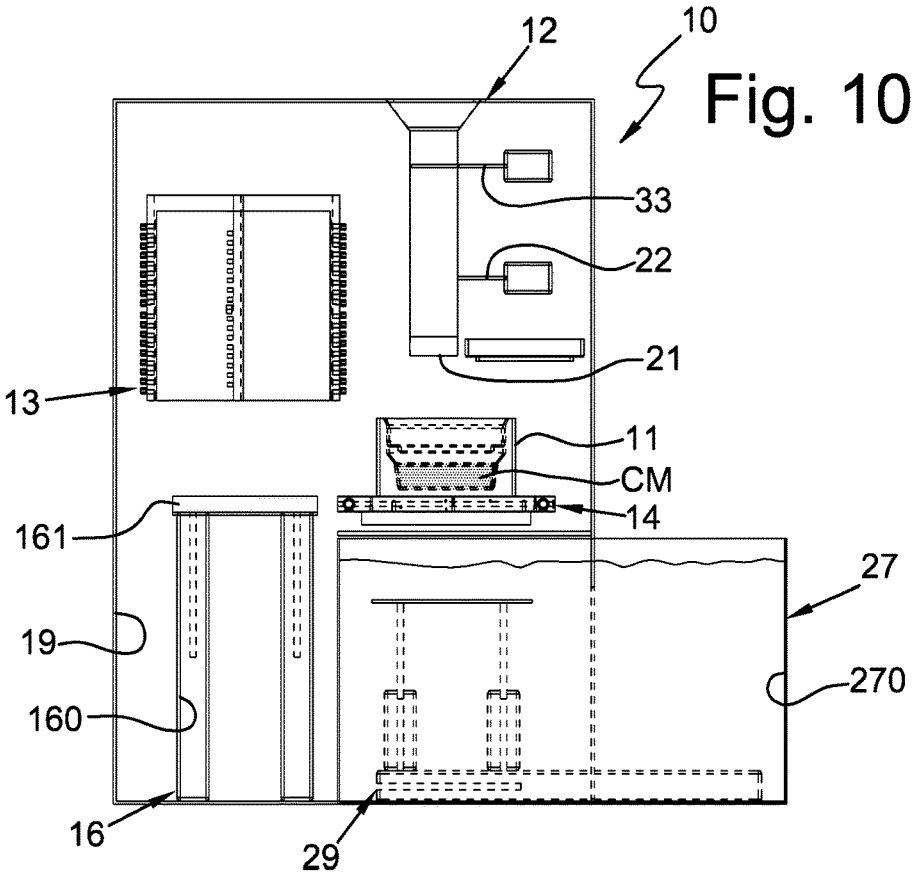
Figure 10D:
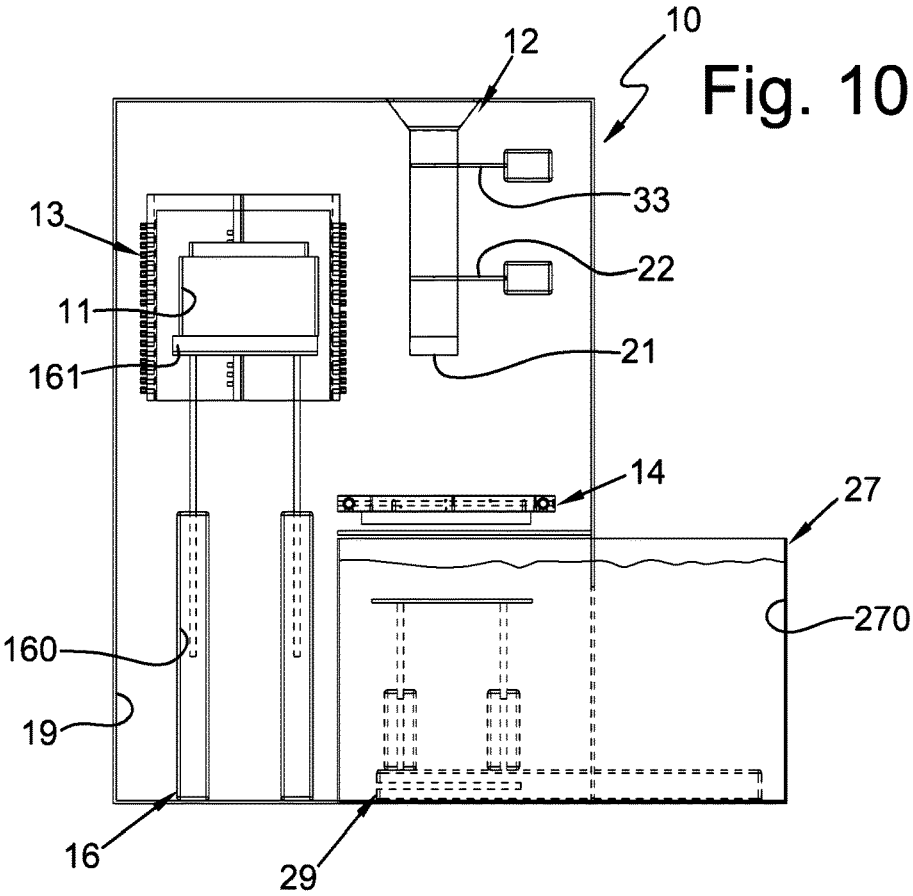
Figure 10E:
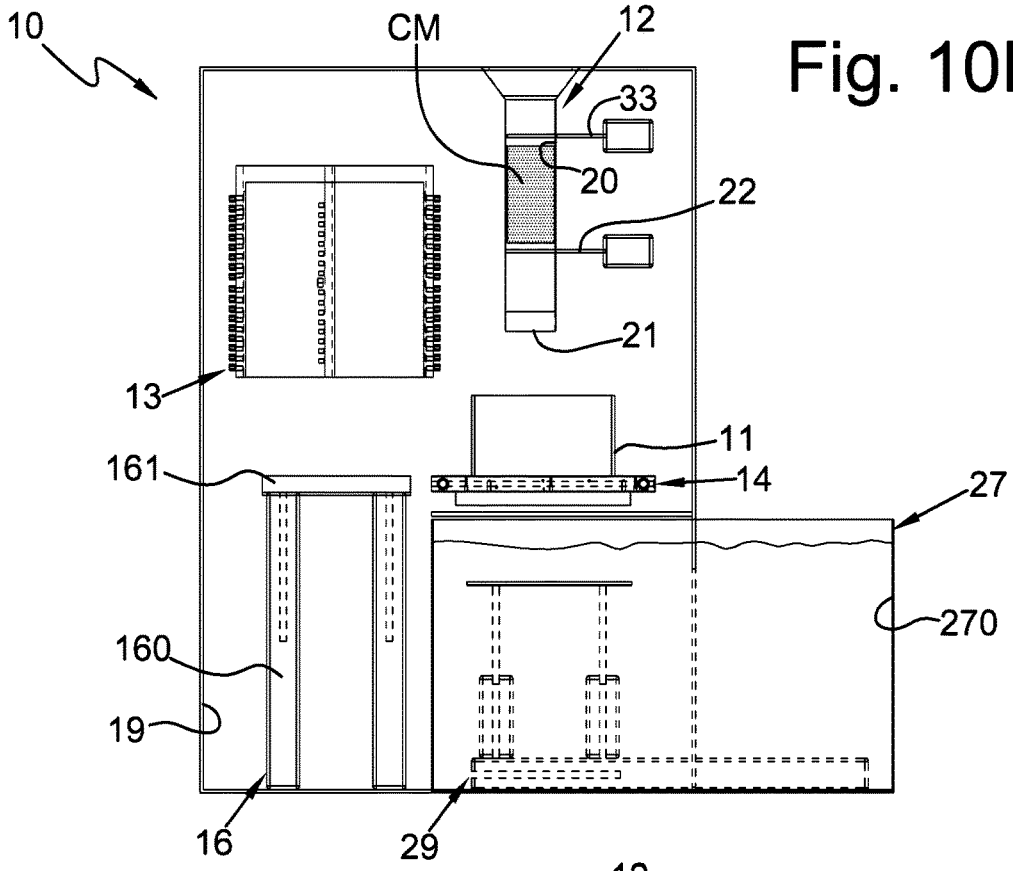
Figure 10G:
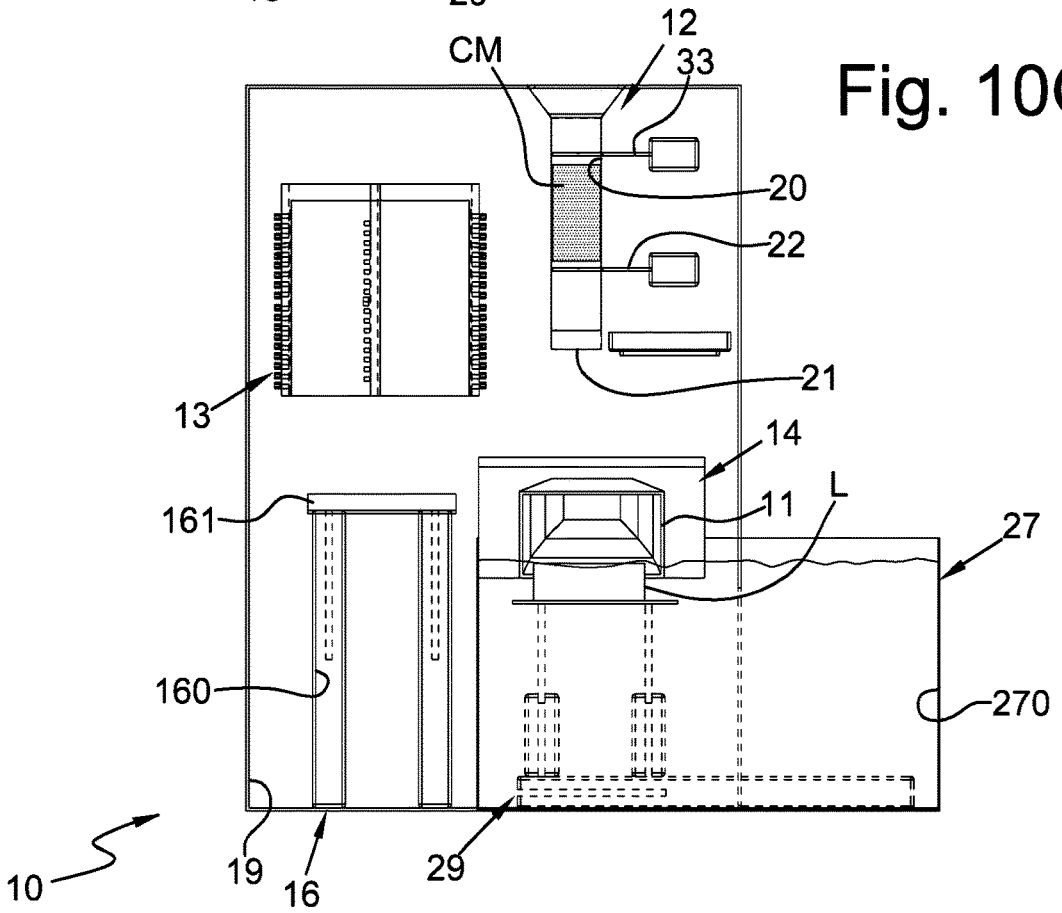
Figure 10H:
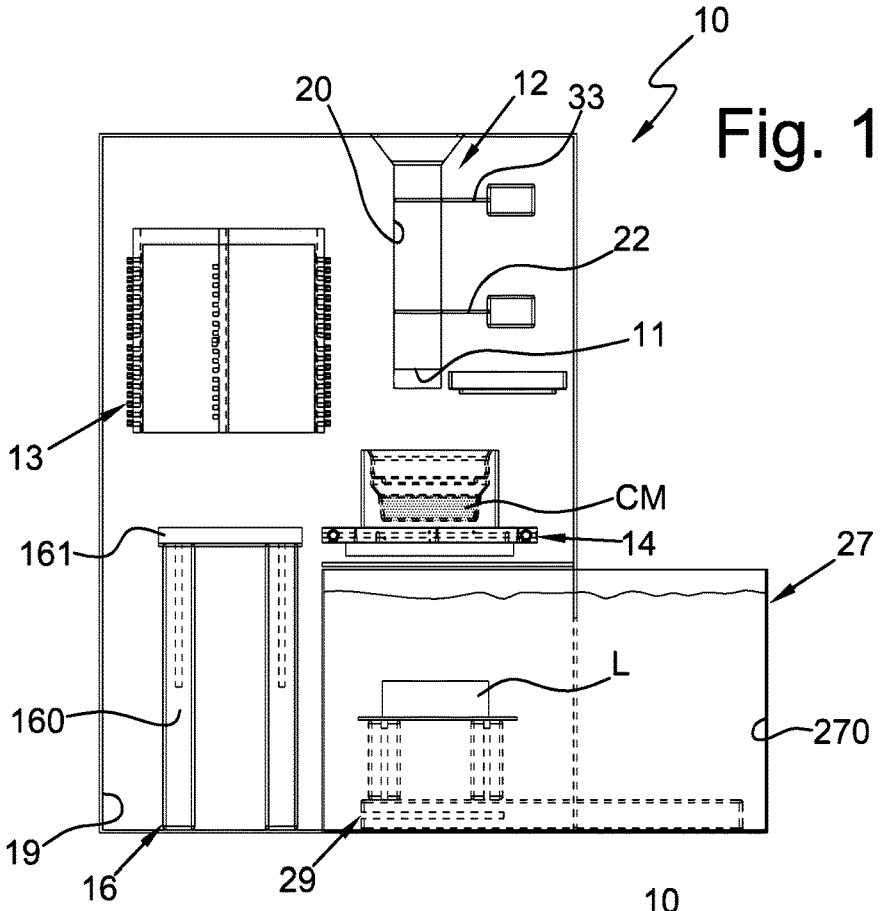
Figure 10I:
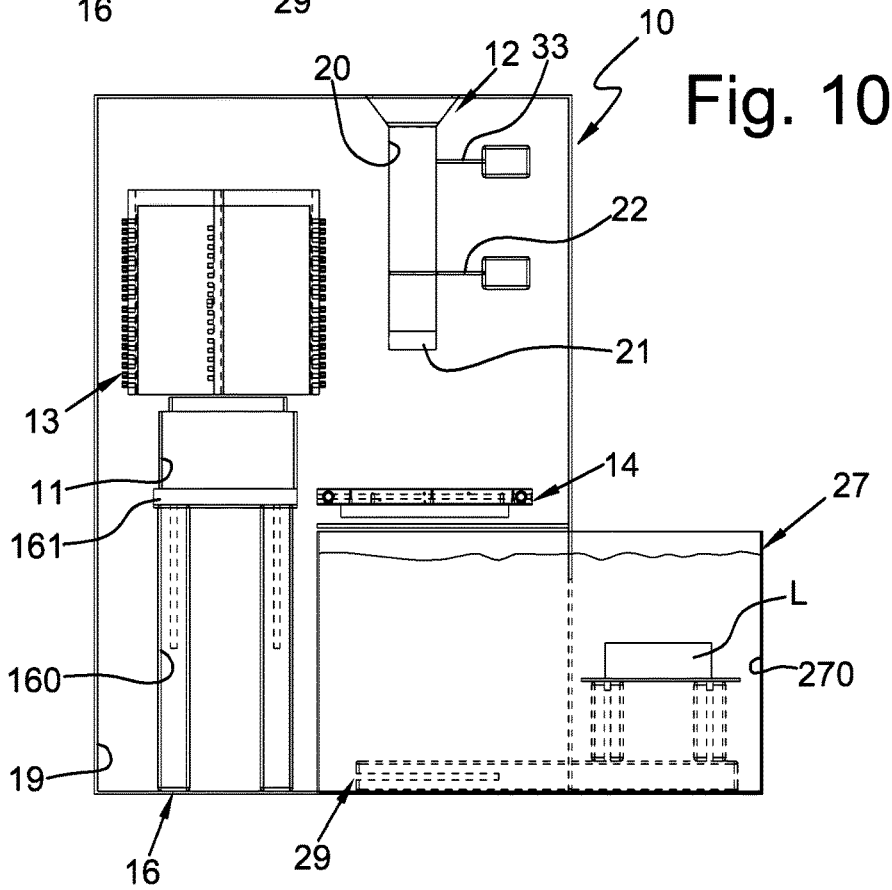
Figure 12A:
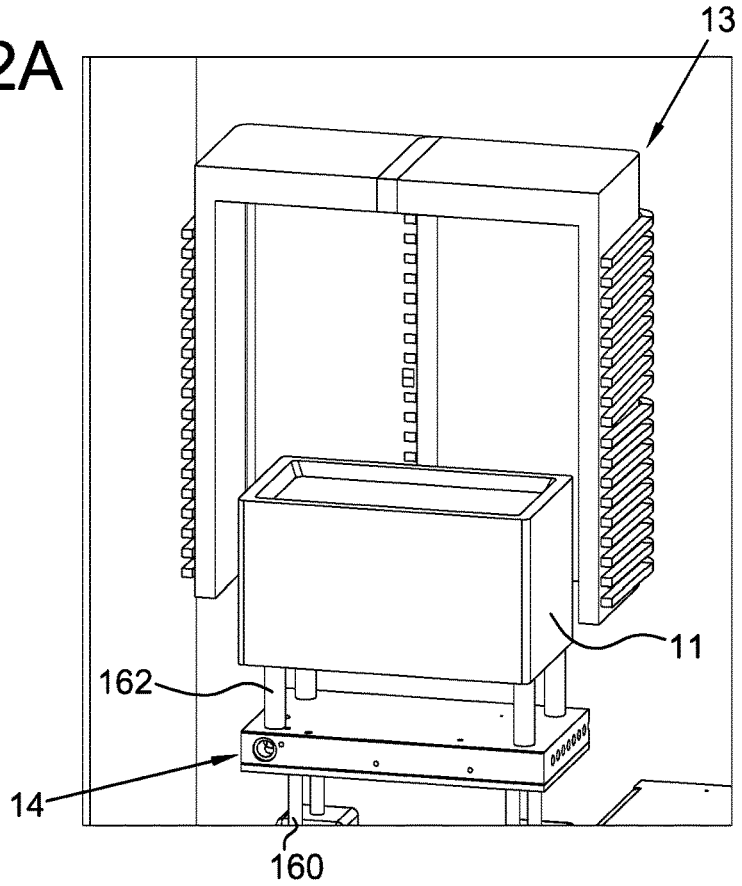
Figure 12B:
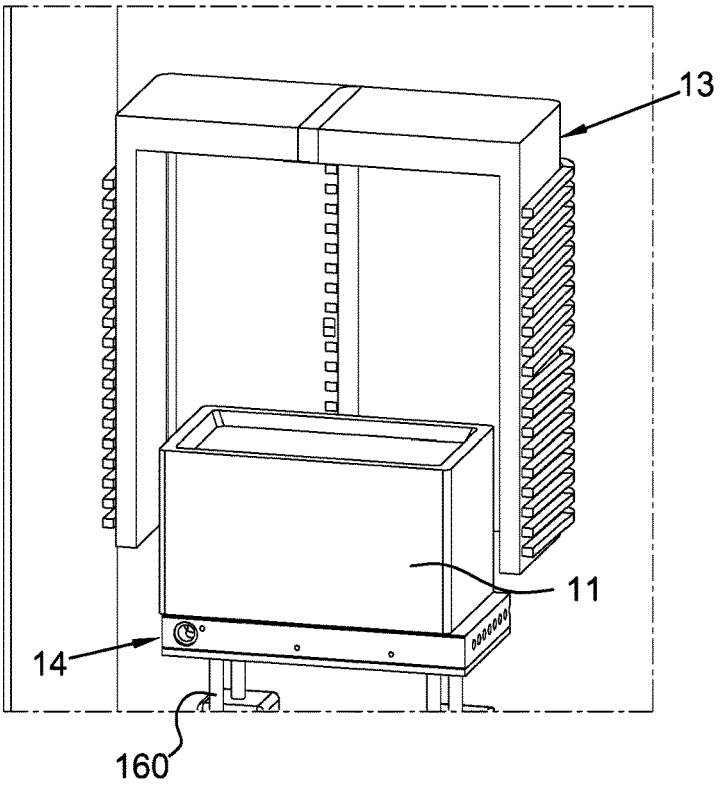
Figure 14:
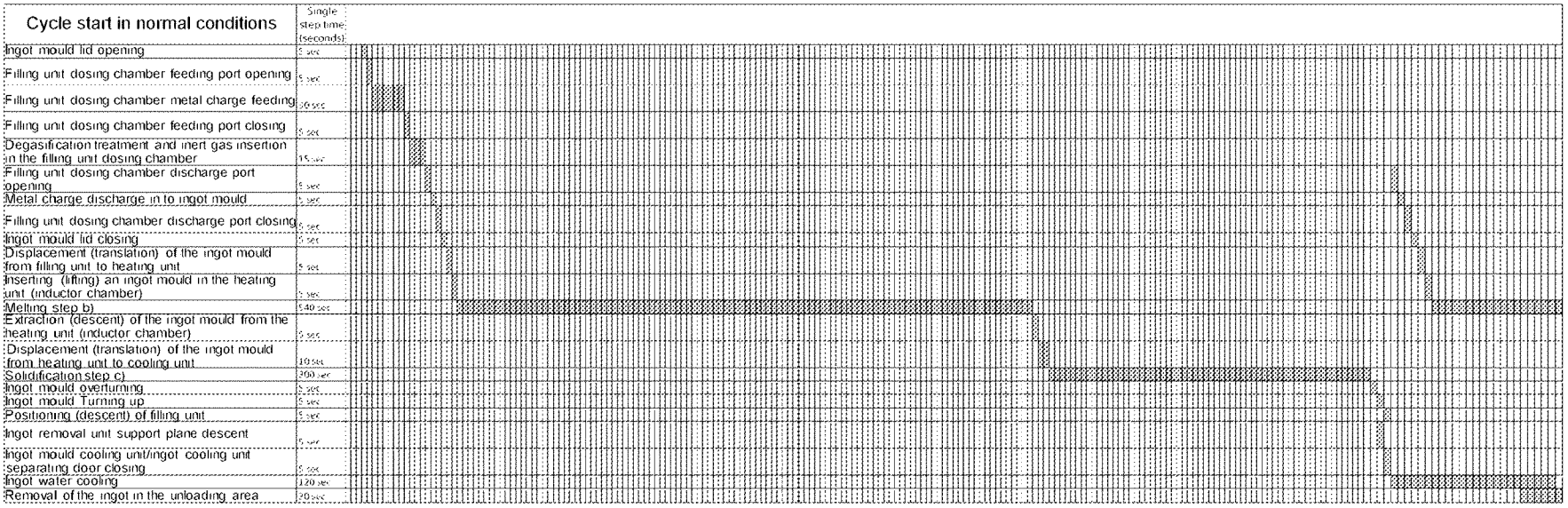

FIGS. 10A to 10E, 10G to 10I, and 10L schematically show the apparatus of FIG. 9 in different successive operating steps for implementing the process according to the present invention;

FIG. 11 is a schematic partially sectional view of a fifth possible embodiment of the apparatus according to the present invention;

FIGS. 12A and 12B schematically show a detail of the apparatus of FIG. 11 in two successive operating steps for implementing the process according to the present invention;

FIGS. 13 and 14 are tables showing the execution times of the main steps of the production process according to the present invention, which can be implemented with an apparatus as shown in FIGS. 1 and 5 and in FIG. 9, respectively.

It is noted that in the following description, corresponding elements will be indicated with the same reference numerals.

For simplicity of representation, moreover, some elements have been schematically indicated only in some of the accompanying figures (FIGS. 1, 3, 5 and 9); they, however, are intended to be present anyway. The remaining figures schematizing the process steps show the apparatus in a simplified form.

With reference to the accompanying figures, reference numeral 10 globally refers to an apparatus for producing metal ingots.

The apparatus 10 is configured to implement the process for producing metal ingots according to the present invention.

The apparatus 10 comprises:

at least one ingot mould 11 for forming at least one ingot L;

at least one filling unit 12 for filling the at least one ingot mould 11 with at least one metal charge CM in the solid state for forming the at least one ingot L;

at least one heat treatment unit for heating the at least one ingot mould 11 to a heating temperature $T_{rs}$ that is higher than or equal to the melting temperature $T_f$ of the at least one metal charge CM for melting the metal charge in the solid state and for natural or forced cooling of the at least one ingot mould 11 to a cooling temperature $T_{rf}$ that is lower than the melting temperature $T_f$ and higher than ambient temperature $T_a$ for solidifying the molten metal charge CM into a respective ingot L;

at least one extraction unit 15 for extracting the at least one ingot L from the at least one ingot mould 11;

a control unit 17 configured to control the at least one filling unit 12, the at least one heat treatment unit and the at least one extraction unit 15 so as to carry out the process for producing metal ingots according to the present invention and as described above.

The at least one heat treatment unit comprises at least one heating unit 13 for heating the at least one ingot mould 11 to a heating temperature $T_{rs}$ that is higher than or equal to the melting temperature $T_f$ of the at least one metal charge CM for melting the metal charge CM in the solid state.

In addition to the at least one heating unit 13, the at least one heat treatment unit may further comprise at least one cooling unit 14 for natural or forced cooling of the at least one ingot mould 11 to a cooling temperature $T_{rf}$ lower than the melting temperature $T_f$ and higher than the ambient temperature $T_a$ for the solidification of the melted metal charge CM in a respective ingot L. Although, at the expense of the process efficiency, the cooling of the at least one ingot mould for the conduction of the solidification step c) could occur naturally simply by interrupting the operation of the at least one heating unit 13.

The apparatus 10 may comprise at least one handling assembly 16 for moving the at least one ingot mould 11 between the at least one filling unit 12, the at least one heat treatment unit (comprising at least one heating unit 13 and optionally at least one cooling unit 14) and the at least one extraction unit 15.

The at least one handling assembly 16 is also controlled by the control unit 17. The apparatus 10 further comprises at least one temperature detecting device 18 for detecting the temperature of the at least one ingot mould 11 and which is operatively connected to the control unit 17, wherein the control unit 17 is configured to control the at least one filling unit 12, the at least one heat treatment unit (comprising at least one heating unit 13 and optionally at least one cooling unit 14), the at least one extraction unit 15 and, if present, the at least one handling assembly 16 so as to implement the process for producing metal ingots according to the present invention and as described above as a function of the temperature detected by the at least one temperature detecting device 18.

In a preferred embodiment, the apparatus 10 comprises at least one closed chamber 19 inside which there are arranged at least:

the at least one heat treatment unit of the at least one ingot mould 11, which heat treatment unit in turn comprises the at least one heating unit 13 and, optionally, the at least one cooling unit 14 of the at least one ingot mould 11, the at least one extraction unit 15 for extracting the at least one ingot L from the at least one ingot mould 11; and the at least one ingot mould 11.

In this case, the at least one filling unit 12 comprises at least one dosing chamber 20 provided with at least one discharge port 21 for discharging the solid metal charge CM in the at least one ingot mould 11, wherein the at least one discharge port 21 is closed by a respective on-off valve 22 and leads into the closed chamber 19.

The at least one handling assembly 16, if present, is associated with the closed chamber 19 to operate on the at least one ingot mould 11 arranged within the latter.

The apparatus 10 also comprises:

at least a unit 23 for generating a substantially inert atmosphere or vacuum, which is connected to the at least one closed chamber 19 for generating a substantially inert atmosphere or vacuum conditions within it.

The closed chamber 19 may consist of a single space housing at least the at least one heat treatment unit, the at least one extraction unit 15 and the at least one discharge port 21 of the at least one filling unit 12.

According to a possible alternative embodiment, the closed chamber 19 may consist of or be divided into two or more spaces or compartments, each of which houses one or more operating units including at least: the at least one heat treatment unit, the at least one extraction unit 15 and the at least one discharge port 21 of the at least one filling unit 12. In this case, such spaces or compartments are in communication with each other through walls 24, 25 and 26, or movable or removable barriers and/or through protected paths, for example of the tunnel type, intercepted by respective walls o movable or removable barriers, wherein the at least one substantially inert or vacuum atmosphere generating unit 23 is connected to the closed chamber for the generation of a substantially inert atmosphere or vacuum conditions within each of these spaces or compartments and of each of these possible tunnel-type protected paths.

Where the at least one heat treatment unit comprises at least one heating unit 13 and at least one cooling unit 14, the latter may be housed in the same compartment or space or in two compartments or spaces separated by walls or movable or removable barriers.

As immediately apparent to the skilled person, the apparatus 10 may comprise two or more filling units 12, two or more heat treatment units (each of which in turn comprises at least one heating unit 13 and optionally at least one cooling unit 14, a same cooling unit 14 being able to serve two or more heating units 13 or vice versa), two or more extraction units 15 and two or more ingot moulds 11 operating therebetween by means of at least one handling assembly 16.

The apparatus 10 further comprises at least a cooling unit 27 for cooling down to ambient temperature $T_a$ of ingots L extracted from the at least an ingot mould 11.

In the case in which the apparatus 10 is of the type in which all the operating units, including in particular the at least one extraction unit 15 and the at least one filling unit 12 are located or otherwise operating within one closed chamber 19, the at least one cooling unit 27 may be at least partially housed in the same closed chamber 19 or in a space or compartment thereof.

In this case, in particular, the at least one cooling unit 27 may comprise at least one tank 270 containing a cooling fluid (water) which is at least partially housed in the closed chamber 19 or in a space or compartment thereof through an opening formed in the walls of the closed chamber 19 and forming a leaf, so that the cooling fluid (water) acts as an isolation barrier between the environment within the closed chamber 19 and the environment outside the closed chamber 19.

The apparatus 10 then comprises at least one removal unit 29 for removing the ingots L extracted from the at least one ingot mould 11 from the at least one closed chamber 19.

The at least one removal unit 29 is housed in a compartment that is in communication with the closed chamber 19 and with the environment outside the closed chamber 19 and that is provided with barrier means adapted to isolate the atmosphere generated inside the closed chamber 19 from the atmosphere of the environment outside the closed chamber 19.

In case the at least one cooling unit 27 comprises at least one tank 270 containing a cooling liquid (water) which is at least partially housed in the closed chamber 19, the at least one removal unit 29 is advantageously housed in said tank 270, the cooling liquid (water) acting as a barrier.

It should be noted that the number and layout of the operating units, as well as the number of operating ingot moulds 11 may vary according to production requirements, available space and other factors.

Advantageously, the at least one filling unit 12 is arranged in such a way as to operate in the same space or compartment of the closed chamber 19 in which the at least one heat treatment unit is located and in particular the at least one cooling unit 14, if present. In this case, the at least one extraction unit 15 is preferably arranged to operate in this same space, this allows reducing the time intervals between the solidification c), extraction d) and filling a) steps and, therefore, limiting the drop in the temperature of the ingot mould 11 between the cooling temperature $T_{rf}$ and the extraction Te and filling $T_{rp}$ temperatures.

The at least one heating unit 13 may be of any known type: a burner, an electric heater or an induction heater. It is advantageously of the induction type and, as schematically illustrated in the accompanying figures, comprises a tunnel chamber open at opposite ends and around which one or more coils are wound.

The at least one ingot mould 11 comprises a mould 30, inside which a shaped cavity is formed for forming at least one ingot L, and a cover 31 of a removable type.

The at least one ingot mould 11 is made of graphite, or the so-called carbon bonded graphite-clay-ceramic composites, or graphite-free composites (e.g., silicon carbide, alumina, zirconia), all already known for creation of crucibles or ladles for melting or transferring molten metals at high temperatures.

The at least one cooling unit 14 may be of one of the known types; in particular, it may be of the type with variously shaped cooling plates and passed through by a cooling fluid. However, the cooling unit 14 may also consist only of a supporting plane, the cooling (for the purpose of the solidification step c) occurring naturally.

According to an aspect of the present invention, on the other hand, if the apparatus 10 is of the closed chamber type 19, the at least one filling unit 12 is configured to fill the at least one ingot mould 11 with a metal charge CM keeping a substantially inert atmosphere or vacuum conditions inside of the closed chamber 19.

Advantageously, for this purpose the at least one filling unit 12 is configured to pre-treat the same metal charge CM before depositing it in the at least one ingot mould 11 subjecting it to a "washing" with a jet or stream of inert gas or to the creation of a pre-vacuum.

As schematically shown in the accompanying figures, the at least one filling unit 12 comprises at least one dosing chamber 20, which is provided with at least one discharge port 21 for discharging the solid state metal charge CM into the at least one ingot mould 11, and at least one feeding port 32 for feeding the solid metal charge CM into the dosing chamber 20.

The at least one discharge port 21 is closed by a respective on-off valve 22 and opens into the closed chamber 19.

The at least one feeding port 32 is closed by a respective on-off valve 33 and leads outside the closed chamber 19.

The two on-off valves 22 and 33 are for example of the gate type and are alternately and selectively controlled for opening and closing during the loading step of the solid metal charge CM inside the dosing chamber 20 (the on-off valve 22 is closed and the on-off valve 33 is open) and during the discharge step of the solid metal charge CM contained in the dosing chamber 20 into the ingot mould 11 (the on-off valve 22 is open and the on-off valve 33 is closed).

The at least one filling unit 12 also comprises an auxiliary unit for generating inert atmosphere or vacuum conditions 34 and which is connected to the dosing chamber 20 for generating a substantially inert atmosphere or vacuum conditions therein, that is, to pre-treat the solid state metal charge CM fed therein before it is discharged into the ingot mould 11 (filling step a)).

To this end, keeping both on-off valves 22, 33 closed, the metal charge CM fed into the dosing chamber 20 is impinged by a jet or an inert gas stream of the nitrogen or argon type, or by the creation of a pre-vacuum.

In the embodiments shown in the accompanying figures, the dosing chamber 20 is of the gravity type and consists of a section of a duct in communication with the environment inside the closed chamber 19 through the at least one discharge port 21 and in communication with the environment outside the closed chamber through the at least one feeding port 32.

In a preferred embodiment, the at least one filling unit 12 is relatively movably supported towards and away from the at least one ingot mould 11, so as to limit, during the filling step of the latter, any leaks of material.

The at least one extraction unit 15 may be of one of the known types operating for tilting the ingot mould 11 or for picking up the ingot L contained therein by means of manipulators of the grippers, suction (suction cups) or other type.

In the event that the at least one cooling unit 14 is of the cooled plate or support surface type, advantageously the extraction unit 15 consists of a mechanism able to rotate the cooled plate or the support plane by more than 90° with respect to a horizontal axis so as to discharge the ingot L contained in the ingot mould 11.

The at least one removal unit 29 may consist of a conveyor of various kinds.

For example, it may consist of a belt conveyor, roller conveyor or the like, or may consist of a support plane mounted on a carriage sliding along sliding guides, wherein the support plane is mounted on the sliding carriage in an advantageously movable way along a vertical direction in order to be moved to different heights.

The at least one cooling assembly 27 for cooling the ingots L to ambient temperature $T_a$ may be of one of the known types: immersion in a tank containing a cooling fluid (water), jet or rain liquid of a cooling fluid (water), cooling plane or even simply natural cooling in the air.

The at least one temperature detecting device 18 may be of the thermocouple type, an optical pyrometer or other known type.

The at least one handling assembly 16 may be of the type with linear actuators (as schematically represented in the accompanying figures) acting on ingot moulds 11, belt conveyor, roller conveyors or the like.

The apparatus 10 further comprises at least a manipulator 35, for example gripper, suction or the like, for handling the lid 31 of the at least one ingot mould 11.

The first embodiment of the apparatus 10 shown in FIGS. 1 and 2A to 2H comprises a "base unit" consisting of a heat treatment unit, in turn comprising a heating unit 13 and a cooling unit 14, a filling unit 12 and an extraction unit 15 which are housed in a closed chamber 19 and between which an ingot mould 11 is movable.

The apparatus 10 then comprises a displacement unit 29 and a cooling unit 27 of the immersion type in a tank 270 containing a cooling liquid (water). Between the cooling unit 27 and the cooling unit 14 and the extraction unit 15 there is interposed a movable door which prevents the vapours generated during the cooling of the ingots from impinging in particular the cooling unit 14.

Between the heating unit 13 and the cooling unit 14 there is interposed a mobile door 24 suitable for thermally shielding these two units.

The heating unit 13 is of the induction type with a tunnel heating chamber. The latter is arranged in such a way that its longitudinal axis is parallel to a horizontal plane.

The cooling unit 14 is of the cooled plate type above which the filling unit 12 is located. The cooling unit 14 is advantageously aligned with the heating unit 13.

The extraction unit 15 is of the overturning cooled plate type.

The cooling unit 27 is located below the cooling unit 14 and the extraction unit 15 to receive the ingot L extracted from the mould 11.

The removal unit 29 is of the support plane type mounted on a carriage sliding along sliding guides towards and away from the closed chamber 19, wherein said support plane is mounted on the carriage in a movable way along a vertical direction for being arranged at different heights.

The removal unit 29 is housed in the tank 270 of the cooling unit 27.

With reference to FIGS. 2A to 2H, the steady state operation (excluding the starting transients) of the apparatus of FIG. 1 for the implementation of the production process according to the present invention is briefly described.

Figure 2A:
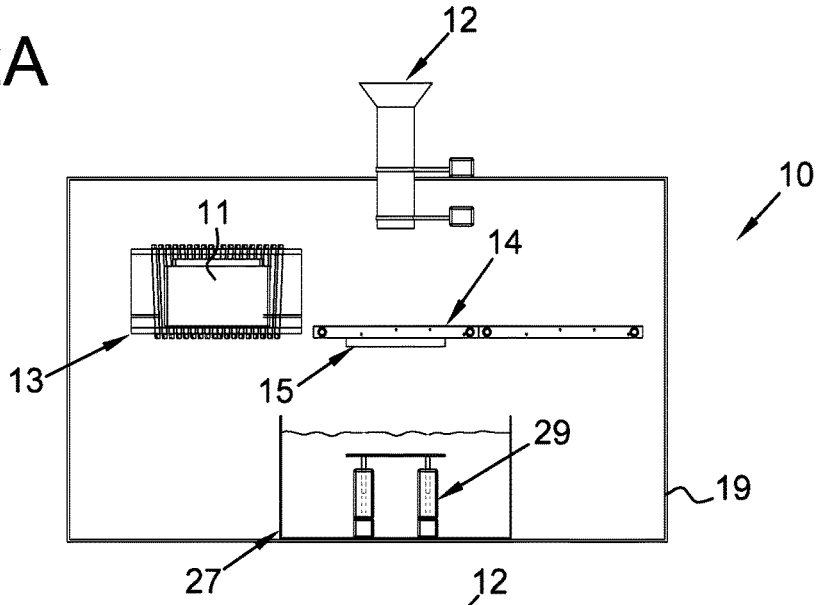

FIG. 2A shows the ingot mould 11 at the heating unit 13 for melting the metal charge CM contained therein (melting step b)). The ingot mould 11 is brought to the heating temperature $T_{rs}$. The melting step b), under normal operating conditions, has a duration of the order of 10 minutes, depending also on the type of metal material and the quantity thereof.

During the melting step b) the movable wall 24 is arranged to separate the heating unit 13 from the cooling unit 14.

Figure 2B:
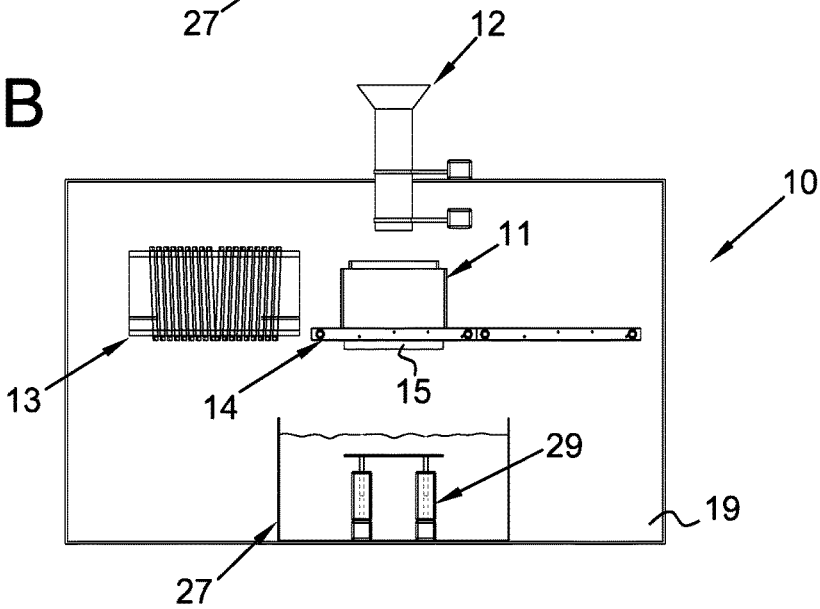

Once the melting step b) has been completed, the ingot mould 11 is moved to the cooling unit 14 where the ingot mould 11 is cooled until it reaches the cooling temperature $T_{rf}$ set for a time sufficient for the complete solidification of the molten metal charge CM (solidification step c), FIG. 2B). The solidification step b) has a duration of the order of 5 minutes, depending also on the type of metal material and the quantity thereof.

Figure 2C:
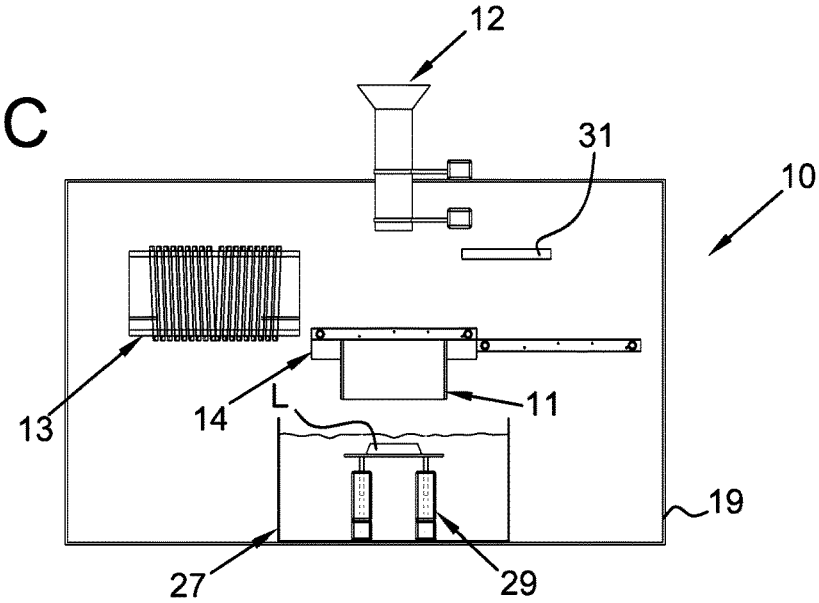

Once the solidification step c) is completed, when the ingot mould is at the cooling temperature $T_{rf}$ at which the solidification step has taken place, the ingot mould 11 is opened and the ingot L solidified therein is extracted through the extraction unit 15: the cooling plate is rotated by more than 90° overturning the ingot mould 11 which discharges the ingot L directly into the tank 270 of the cooling unit (FIG. 2C). The movable door 25 interposed between the cooling unit 14 and the cooling unit 29 is opened.

The extraction step d) thus carried out has a duration of the order of 20-30 seconds, including the return of the empty ingot mould 11 to a straight position.

The extraction step d) takes place when the ingot mould 11 is at an extraction temperature $T_e$ close to the cooling temperature $T_{rf}$ at which the solidification step c) has been carried out.

Figure 2D:
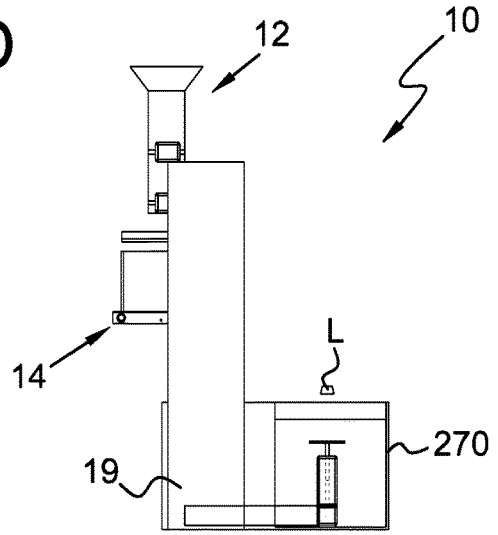
Figure 2E:
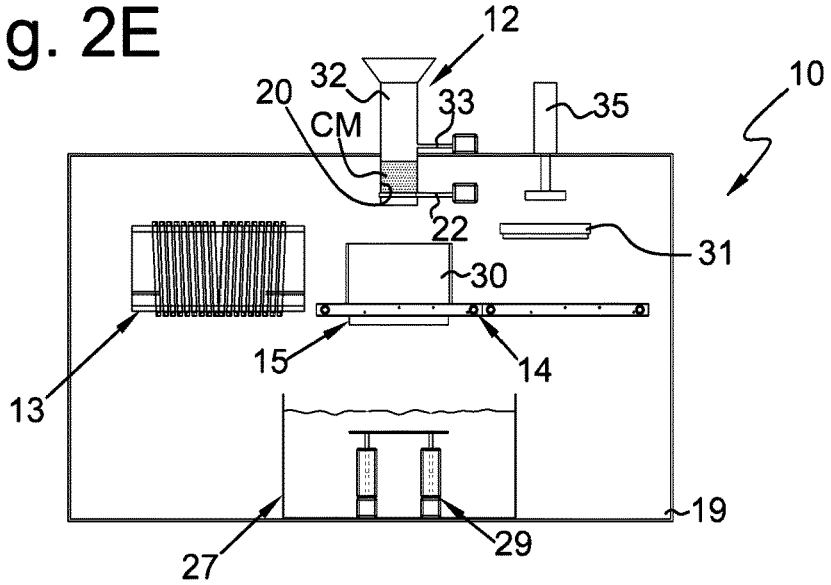
Figure 2F:
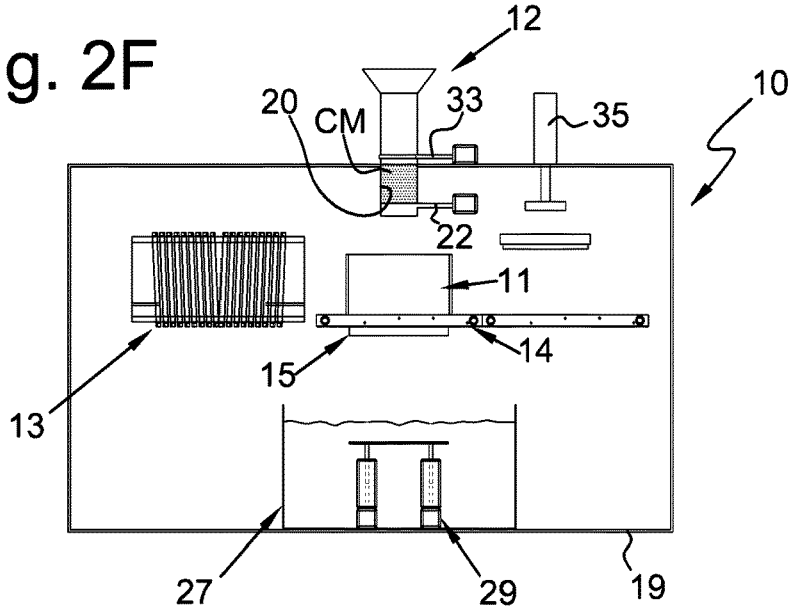
Figure 2G:
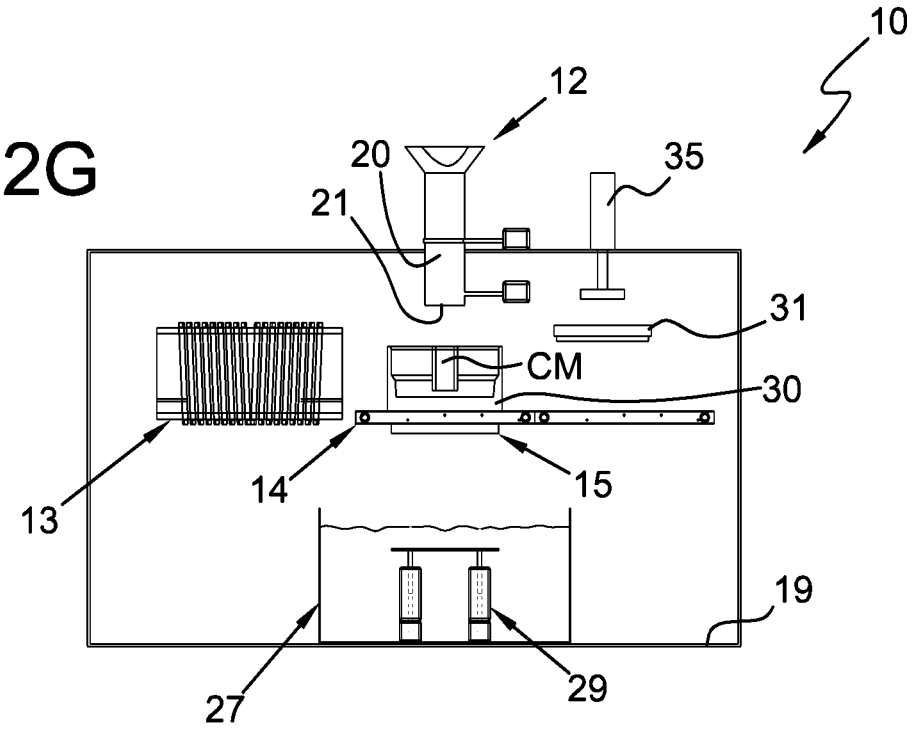
Figure 2H:
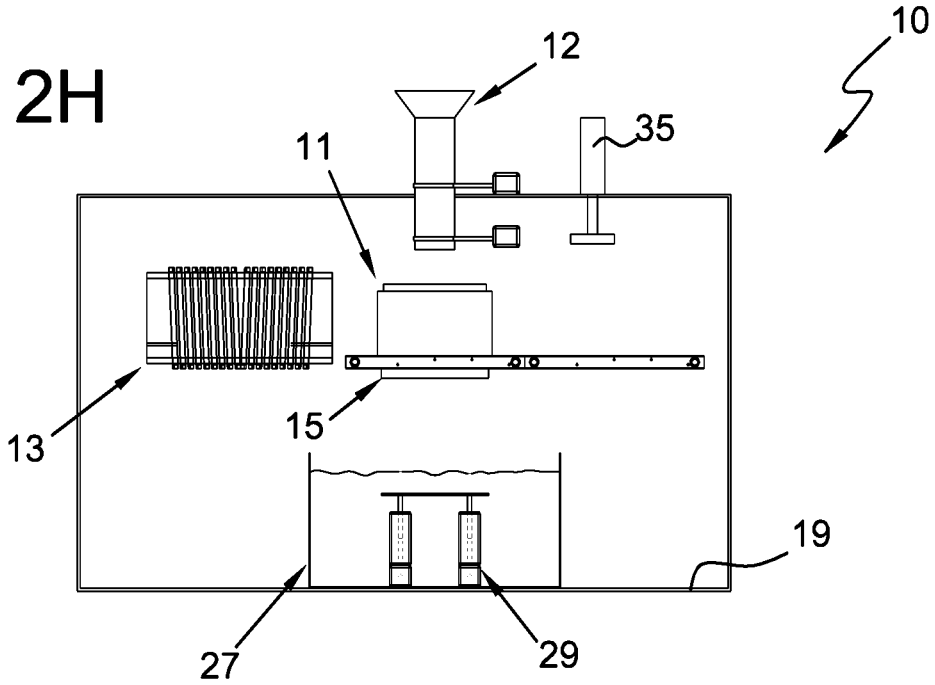

As soon as the emptied ingot mould 11 is returned to a turned up position (FIG. 2E), the filling unit discharges the metal charge CM already fed and "inertized" into the ingot mould 11 (filling step a)), which is then closed with its own lid and moved at the heating unit 13 for the beginning of a subsequent cycle (FIGS. 2F-2H).

The filling step a) thus carried out has a duration of the order of 20-30 seconds, including the closing of the ingot mould 11.

The filling step a) thus takes place when the ingot mould 11 is at a filling temperature $T_{rp}$ close to the extraction temperature $T_e$ and, therefore, close to the cooling temperature $T_{rf}$ at which the solidification step c) has been carried out.

During the filling step a), the ingot L discharged into the cooling unit 27 is moved away from the closed chamber 19 through the removal unit 29 (FIG. 2D).

During the melting step b) of the subsequent cycle, the filling unit 12 is fed with a new solid metal charge CM, which is subjected to a "washing" pre-treatment with inert gas or vacuum.

The second embodiment of the apparatus 10 shown in FIGS. 3 and 4A-4C differs from the first embodiment in the arrangement and the embodiment of the extraction unit 15, the cooling unit 27 and the removal unit 29.

In this case, the extraction unit 15 is of the manipulator type, of the gripper, suction or similar type, adapted to take the ingot L from the mould 11 and deposit it on a support or transport plane.

The cooling unit 27 is housed in a compartment in communication with the closed chamber 19 and with the environment outside the closed chamber 19 by means of respective doors 26 alternately and selectively movable.

The cooling unit 27 is of the immersion or rain or water jet type (not shown).

The environment inside the compartment housing the cooling unit 27 is also with a substantially inert atmosphere through the same unit 23 for generating a substantially inert atmosphere or other auxiliary unit.

The removal unit 29 consists of a conveyor housed in the same compartment in which the cooling unit 27 is housed.

Figure 3:
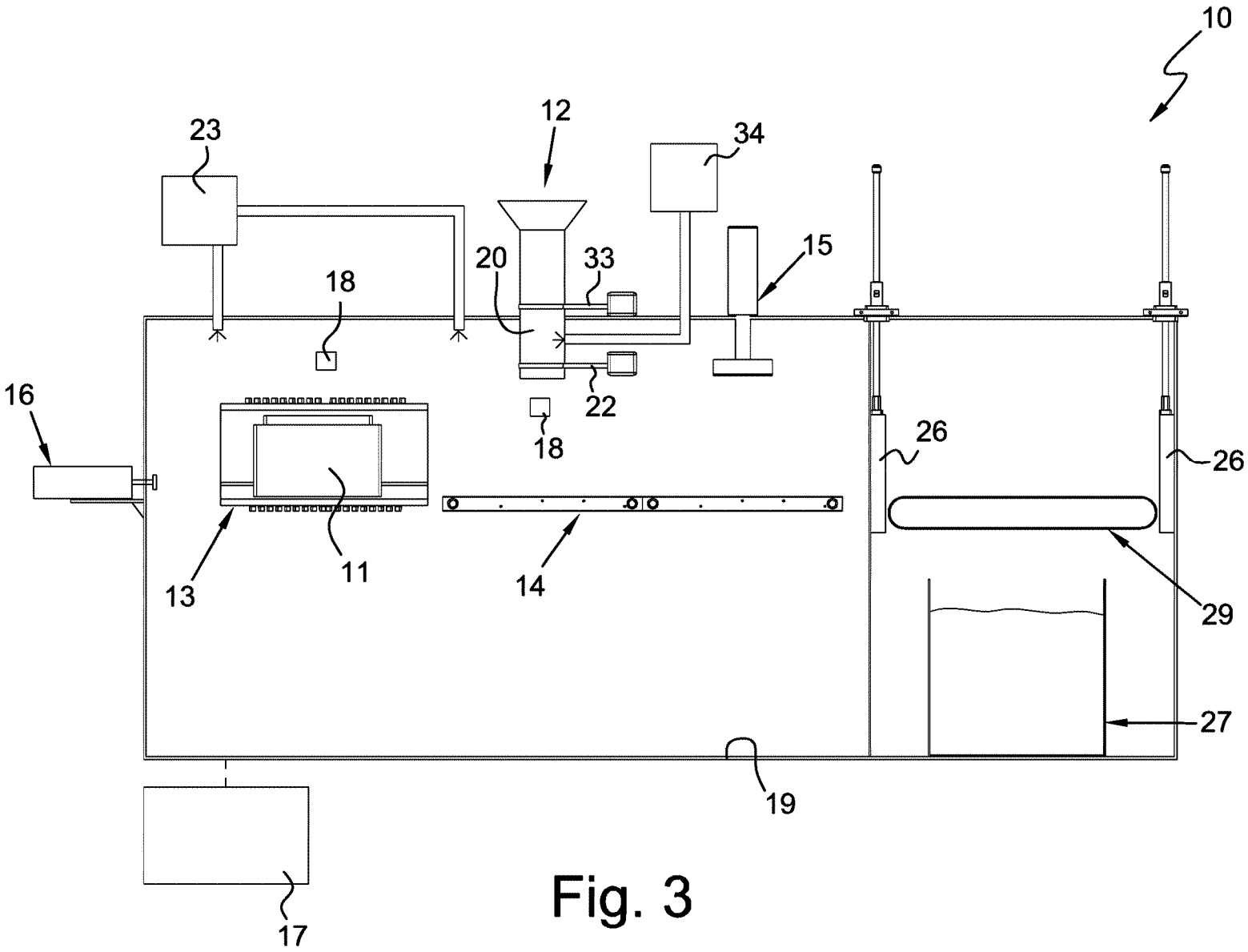
Figure 4A:
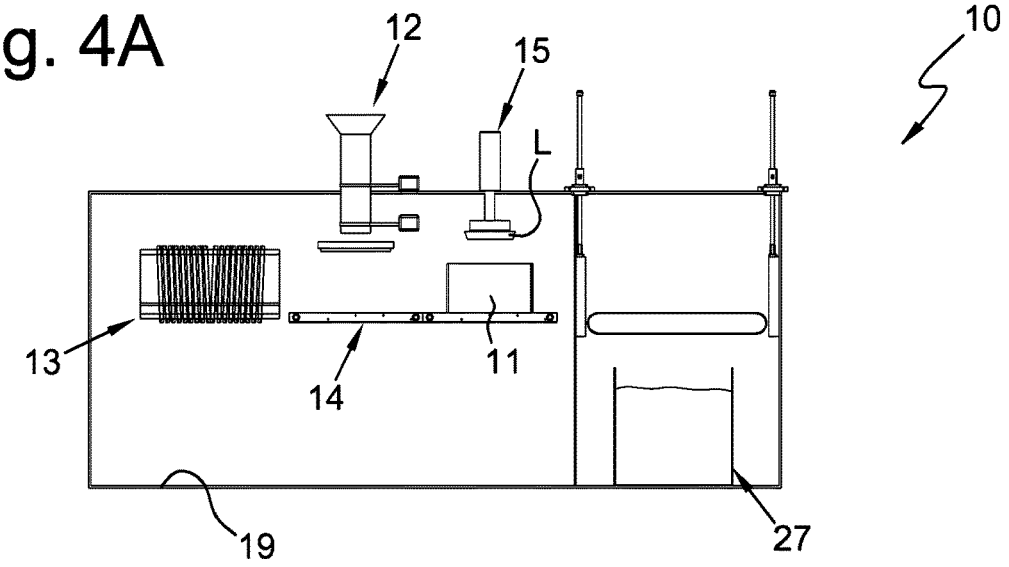
Figure 4B:
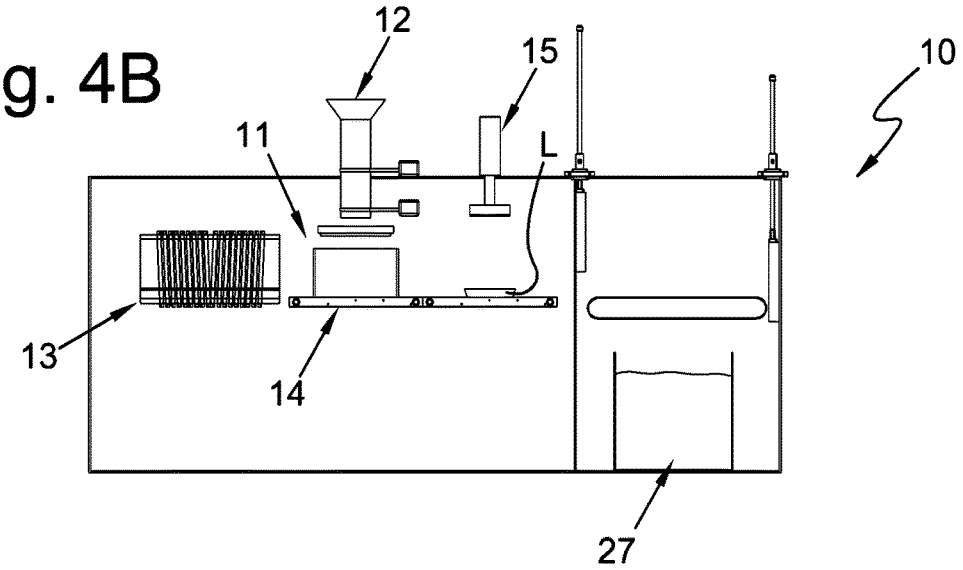
Figure 4C:
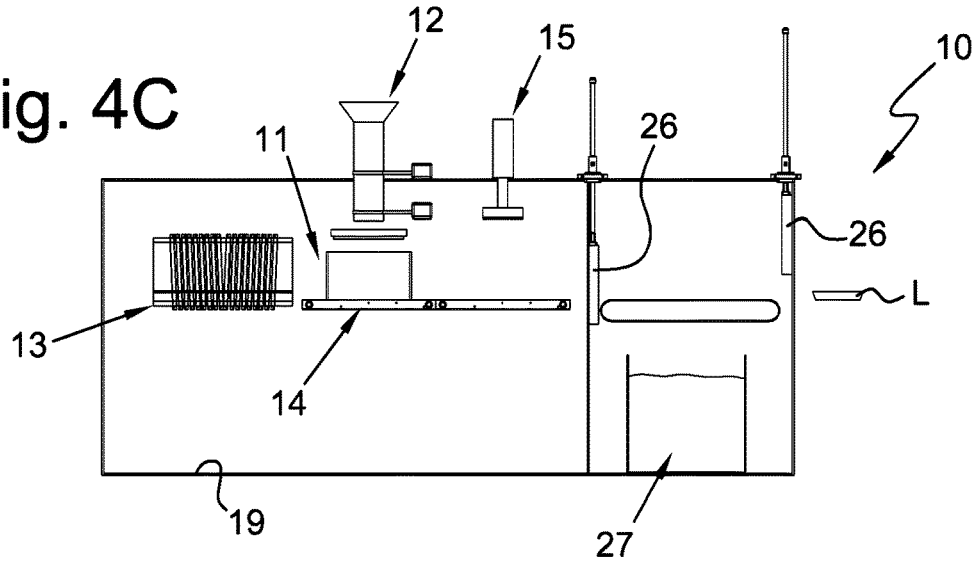

The operation of the apparatus 10 shown in FIG. 3 is similar to that described above with reference to FIG. 1 and from 2A to 2H, except for the methods used to conduct the extraction step d) (FIGS. 4A and 4B), the cooling step f) and the removal step of the ingot (FIG. 4C). It is noted that during the execution of these last two steps, the environment inside the closed chamber 19 is never directly in communication with the environment outside it and the compartment containing the cooling unit 27, due to the provision of at least one pair of doors or barriers 26 alternately and selectively movable separating the compartment housing the cooling unit 17 from the closed chamber and from the external environment, respectively.

Figure 6:
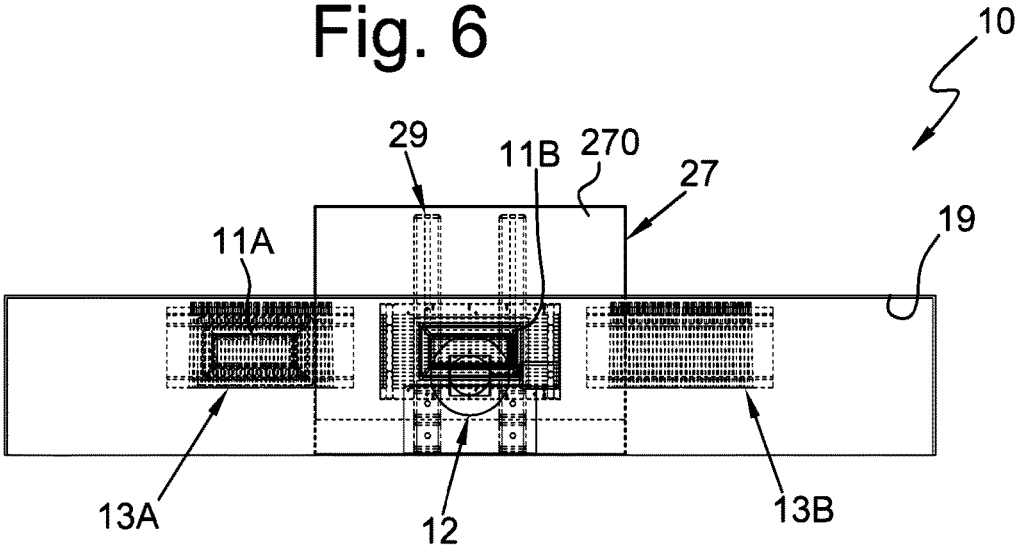
Figure 8:
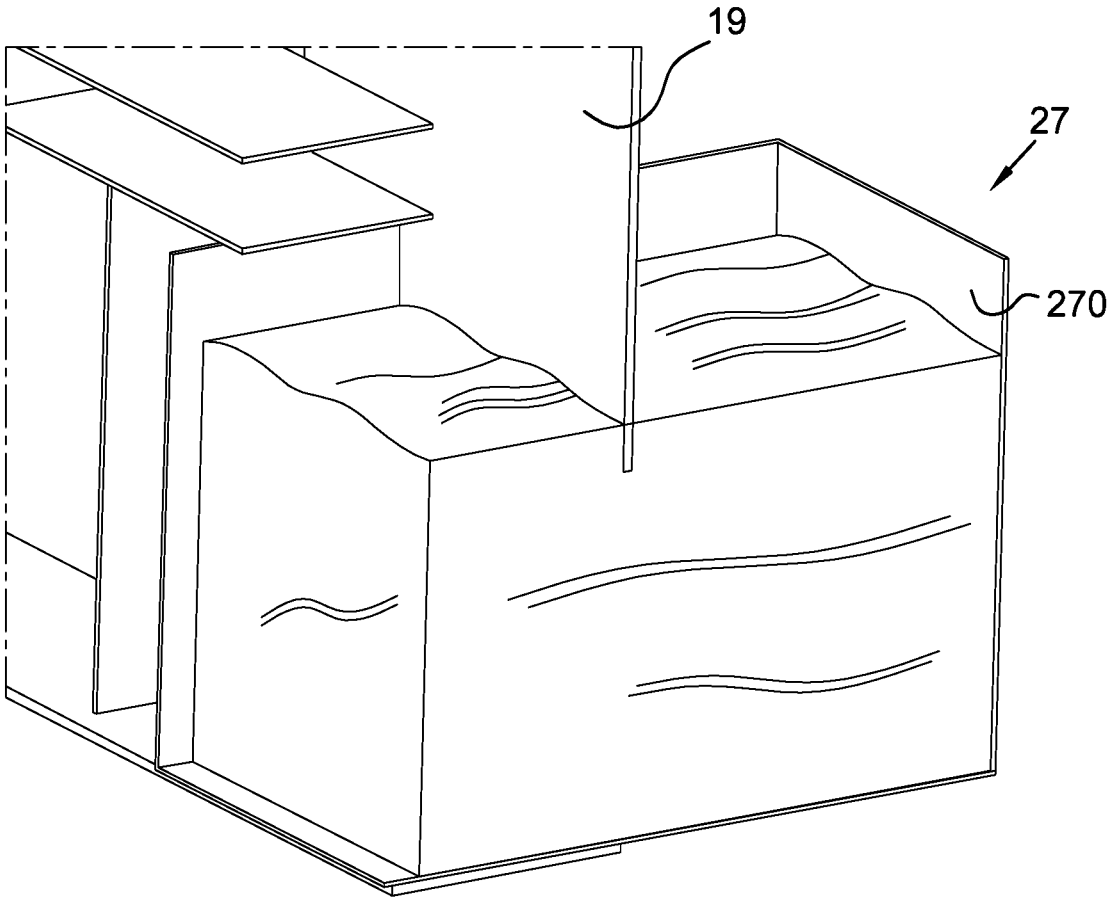
FIG. 8 is a schematic sectional view of a detail of an apparatus according to the present invention.

The third embodiment of apparatus 10 according to the present invention shown in FIGS. 5, 6 and from 7A to 7I and 7L to 7N comprises:

- a heat treatment unit which in turn comprises:
  - a pair of heating units of at least one ingot mould, respectively a first heating unit 13A and a second heating unit 13B, and
  - a single cooling unit 14 of the at least one ingot mould, which are arranged inside a closed chamber 19.

In the closed chamber 19 there is a pair of ingot moulds, respectively a first ingot mould 11A and a second ingot mould 11B.

The first and second heating units 13A, 13B are of the induction type, whose tunnel heating chambers are advantageously aligned with their longitudinal axes coaxial and parallel to a horizontal plane.

The cooling unit 14 is arranged to serve both heating units 13; for example, as shown in the accompanying figures, the cooling unit 14 is interposed to the heating units 13A, 13B in an arrangement aligned along a horizontal direction.

The at least one handling assembly 16 is arranged to move:

- the first ingot mould 11A between the first heating unit 13A, the cooling unit 14, the extraction unit 15 and the filling unit 12, and
- the second ingot mould 11B between the second heating unit 13B, the cooling unit 14, the extraction unit 15 and the filling unit 12.

The handling assembly 16 can be configured to move the two ingot moulds 11A, 11B simultaneously synchronously or independently of each other also in delayed times.

For the remainder, the apparatus 10 is of the type shown in FIG. 1, to the description whereof reference is made in particular with regard to the arrangement and construction of the filling unit 12, the extraction unit 15, as well as the cooling unit 27 and the removal unit 29.

In this case, under normal operating conditions, operating periods in which the first ingot mould 11A is heated by the first heating unit 13A, while the second mould 11B is cooled by the cooling unit 14 alternate with operating periods in which the first ingot mould 11A is cooled by the cooling unit 14, while the second ingot mould 11B is heated by the second heating unit 13B. This allows increasing the productivity of the apparatus 10.

It should be noted that, as immediately understood by the skilled person, it is possible to implement the apparatus 10 with a pair of cooling units and a heating unit common to the two cooling units.

Also in this case, in the light of the above description and of the accompanying figures, the skilled person has no difficulty in understanding the operation of the apparatus 10 shown in FIGS. 5, 6, 7A to 7I, and 7L to 7N for the implementation of the process according to the present invention.

With reference to the accompanying figures, FIGS. 7A-7E show initial start-up steps of the apparatus 10:

- the second ingot mould 11B is at the respective second heating unit 11B, at which it is heated,
- the first mould 11A is at the filling unit 12 (arranged at the cooling unit 14), at which a metal charge CM is discharged into the first ingot mould 11A which is then closed with the respective lid.

The first ingot mould 11A thus filled is displaced at the first heating unit 13A and as soon as the second mould 11B has reached the desired heating temperature it is displaced at the filling unit 12 (FIG. 7F). The movement of the two ingot moulds may be synchronous or independent.

The second ingot mould 11B is in turn filled with a metal charge CM by the filling unit 12.

The first ingot mould 11A is heated up to the heating temperature $T_{rs}$ for a time sufficient to completely melt the metal charge CM present therein (melting step b)). The melting step b), under normal operating conditions, has a duration of the order of 10 minutes, depending also on the type of metal material and the quantity thereof.

As soon as the melting of the metal charge present in the first ingot mould 11A has occurred, it is displaced at the cooling unit 14. The second ingot mould 11B is displaced at the second heating unit 13B. The displacement of the second ingot mould 11B between the filling unit 12 and the second heating unit 13B may occur simultaneously and synchronously with the movement of the first ingot mould 11A from the first heating unit 13A to the cooling unit 14 or independently also in delayed times (FIG. 7G).

The first mould 11A is cooled until it reaches the cooling temperature $T_{rf}$ set for a time sufficient to complete the solidification of the molten metal charge CM (solidification step c)). The solidification step b) has a duration of the order of 5 minutes, depending also on the type of metal material and the quantity thereof.

Once the solidification step c) is completed, when the first ingot mould 11A is at the cooling temperature $T_{rf}$ at which the solidification step has taken place, the first ingot mould 11A is opened and the ingot L solidified therein is extracted through the extraction unit 15: the cooling plate is rotated by more than 90° overturning the ingot mould 11 which discharges the ingot L directly into the tank 270 of the cooling unit (FIGS. 7G and 7H). The movable door 25 interposed between the cooling unit 14 and the cooling unit 29 is opened.

The extraction step d) thus carried out has a duration of the order of 20-30 seconds, including the return of the empty first ingot mould 11A to a straight position (FIG. 7I).

The extraction step d) takes place when the first ingot mould 11A is at an extraction temperature $T_e$ close to the cooling temperature $T_{rf}$ at which the solidification step c) has been carried out.

As soon as the emptied first ingot mould 11A is returned to a turned up position, the filling unit 12 discharges the metal charge CM already fed and "inertized" into the first ingot mould 11A (filling step a)), which is then closed with its own lid and moved at the first heating unit 13A for the beginning of a subsequent cycle (FIGS. 7I and 7L-7N).

The filling step a) out has a duration of the order of 20-30 seconds, including the closing of the first ingot mould 11A.

The filling step a) thus takes place when the first ingot mould 11A is at a filling temperature $T_{rp}$ close to the extraction temperature $T_e$ and, therefore, close to the cooling temperature $T_{rf}$ at which the solidification step c) has been carried out.

During the filling step a), the ingot L discharged into the cooling unit 27 is moved away from the closed chamber 19 through the removal unit 29 (FIGS. 7L and 7M), which returns to the initial position (FIG. 7N).

While the solidification b), extraction d) and filling a) steps of the first ingot mould 11A take place, the second ingot mould 11B is at the second heating unit 13B where the metal charge CM present therein is melted.

When the first ingot mould 11A is displaced at the first heating unit 13A for the start of a subsequent cycle, the second ingot mould 11B is displaced at the cooling unit 14 for carrying out the solidification c), extraction d) and filling a) steps (FIG. 7N) in a completely similar manner to that described above with reference to the first ingot mould 11A.

The feeding of the single metal charges CM in the filling unit 12 takes place, advantageously, in times at least superimposed to the melting and cooling times of the two ingot moulds.

As immediately understood by the skilled person, the step of feeding the solid metal charge CM into the filling unit 12 takes place by:

closing the discharge port 21 through the on-off valve 22, opening the feeding port 32 through the respective on-off valve 33, feeding the previously weighed metal charge CM into the dosing chamber 20, closing the feeding port 32 through the respective on-off valve 33, injecting an inert gas or creating a vacuum in the dosing chamber 20 keeping the discharge and feeding ports closed.

FIG. 13 shows a table in which: the first column shows the main steps of the production process according to the present invention, performed with an apparatus such as that of the first, second and third embodiments, the second column shows the execution times (in seconds) of each step reported in the first column, the third column shows the progressive time (in seconds) from the beginning of the cycle in normal conditions, the fourth column shows a diagram that shows on the horizontal axis the time span of execution of a production cycle divided into incremental stages (each of 5 seconds) according to the process steps indicated in the first column, where the horizontal bars represent the sequence, the duration and the time span of each individual process step. Some times of execution of some process steps are not shown because they are not relevant.

The fourth embodiment of apparatus 10 shown in FIGS. 9, 10A to 10E, 10G to 10I, and 10L differs from the first embodiment shown in FIG. 1 and from 2A to 2H in the relative arrangement of the heating unit 13 and the cooling unit 14 forming the heat treatment unit.

As immediately understandable to the skilled person, in this case the heating unit 13 is of the induction type whose tunnel heating chamber is arranged with its longitudinal axis aligned along the vertical axis.

For the remainder, the apparatus 10 is analogous to that shown in FIG. 1 and from 2A to 2H:

the cooling unit 14 is of the cooled plate type arranged next to the heating unit 13, the filling unit 12 is arranged above the cooled plate forming the cooling unit 14, the extraction unit 15 is of the type suitable for tilting the ingot mould 11 by rotation of the cooled plate.

The cooling unit 27 is of the immersion type whose tank 270 is partially housed in the closed chamber 19 so as to receive the ingots extracted from the ingot mould 11. The tank 270 extends outside the closed chamber 19 through a wall of the latter forming a leaf.

The displacement unit 29 is of the type with a supporting plane mounted on a carriage sliding along sliding guides which extend partly in the closed chamber 19 and partly outside it. The support plane is supported by the carriage in a movable manner along a vertical direction. The entire removal unit 29 is housed in the tank 270.

Also in this case there are provided doors or movable walls 24 and 25 which separate the heating unit 13 from the cooling unit 14 and the cooling unit 14 from the cooling unit 27.

The handling assembly 16 in this case comprises further actuators adapted to move the ingot mould from the cooling unit 14 to the heating unit 13 and vice versa. In the case shown, vertical actuators 160 are provided which support a ceramic support plate 161 of the ingot mould 11 which is alternately insertable and extractable from the heating chamber of the heating unit 13.

The operation of the apparatus 10 shown in FIG. 9 for the implementation of the process according to the present invention is immediately understandable by the skilled person in the light of the above description and of FIGS. 10A-10E, 10G-10I, and 10L which show:

the filling step a) of the ingot mould 11 with a metal charge CM in the solid state (FIGS. 10A-10C), the melting step b) of the metal charge CM loaded into the ingot mould 11, in which the ingot mould 11 is brought to a heating temperature $T_{rs}$ higher than the melting temperature $T_f$ for a time sufficient for the complete melting of the metal charge CM (FIG. 10D), solidification step c) of the metal charge CM in which the ingot mould 11 is cooled to a cooling temperature $T_{rf}$ lower than the melting temperature $T_f$ but higher than the room temperature $T_a$ for a time sufficient to complete the solidification of the metal charge CM (FIG. 10E), the extraction step d) of the ingot L from the ingot mould 11 (FIG. 10G) which occurs when the ingot mould 11 is at an extraction temperature $T_e$ close to the cooling temperature $T_{rf}$ at which the solidification has occurred, the filling step a) of the ingot mould 11 as soon as emptied and at a filling temperature $T_{rp}$ close to the cooling temperature $T_{rf}$ at which solidification occurred with subsequent start of a new cycle (FIGS. 10H, 10I, and 10L), with simultaneous cooling and removal of the ingot L extracted in the previous cycle.

The fifth embodiment shown in FIGS. 11 and 12A-12B differs from that shown in FIGS. 9 and 10A-10E, 10G-10I, and 10L solely in that the cooling unit 14 is aligned with the heating unit 13.

The cooling unit 14 is of the plate type, plate which is cooled in the case in which the cooling is forced or which constitutes a support plane in the case in which the cooling is natural, which is supported by the vertical actuators 161 and is provided with retractable and extensible columns 162 through which the ingot mould 11 is respectively supported and spaced with respect thereto.

FIG. 12A shows the ingot mould 11 during the melting step b), in which the columns 162 are extracted by spacing the ingot mould 11 of the cooling unit 14 and supporting it inside the heated chamber of the heating unit 13.

FIG. 12B shows the ingot mould 11 during the solidification step c), in which the columns 162 are retracted, carrying the ingot mould 11 resting on the plate of the cooling unit 14.

In this case, underneath the filling unit 12, a supporting surface 150 is provided which is preferably of a tilting type.

FIG. 14 shows a table like that in FIG. 13, before the column showing the progressive time, referred to the fourth embodiment of the apparatus for carrying out the process according to the present invention.

It should be noted that the term "unit" used in the present description is to be understood as a synonym of "device", "station" or "apparatus" however implementing the identified functions of heating, cooling (natural or forced), extraction, filling, removal etc.

Finally, it should be noted that the embodiments of the apparatus shown and described are not to be understood in a limiting sense, the number, the arrangement and the constitution of the heating, cooling, extraction, filling and displacement units may vary according to the specific requirements.

Thus, for example, it is possible to provide an apparatus similar to that shown in FIGS. 9 and 11 with two heating units and a cooling unit common to them or vice versa.

Or again it is possible that the apparatus 10 consists of a repetition of "base units" as shown in FIG. 1 or 3.

In general, the at least one cooling unit 14 may be of the plate type on which the ingot mould rests, where said plate is of the cooled type (for example for circulating a cooling fluid therein) in the case where the cooling step is forced or forming a simple support plane in case the cooling step is natural.

From tests conducted it emerged that the process and the production apparatus according to the present invention allow obtaining an energy saving of even 50% compared to known processes and apparatuses of the type in which the melting takes place directly in the ingot moulds in which the solidification takes place, even if the metal feeds are at ambient temperature.

This is due to the fact that the extraction and filling steps are carried out when the ingot mould is respectively at an extraction and filling temperature which are both substantially equal or in any case close to the cooling temperature to which the ingot mould is brought to solidify the metal charge melted; a cooling temperature $T_{rf}$ which is advantageously in a range of 300° C., advantageously of 200° below the melting temperature $T_f$ of the metal charge, while the extraction temperature $T_e$ and the filling temperature $T_{rp}$ are both advantageously in a range of 50°-100° C. below the cooling temperature $T_{rf}$. In the case of metal charges of precious metal material, the extraction temperature $T_e$ and the filling temperature $T_{rp}$ are both higher than 400° C., advantageously higher than 500° C.

The process and the apparatus according to the present invention also allow increasing the production efficiency.

The apparatus according to the present invention is also compact and does not need any manipulation of the ingot moulds outside it for "recirculation" thereof in the production cycle, with consequent simplification of its structure and safety for the operators involved in conducting the same.

The invention claimed is:

1. A process for producing at least one metal ingot, the process comprising:

a) filling at least one ingot mould at a filling temperature $T_{rp}$ with at least one metal charge, which is in a solid state and has a melting temperature $T_f$ that is higher than ambient temperature $T_a$, b) melting said at least one metal charge in the solid state by heating said at least one ingot mould filled with said at least one metal charge in the solid state up to a heating temperature $T_{rs}$ that is higher than or equal to the melting temperature $T_f$ until said at least one metal charge melts thereby obtaining at least one molten metal charge, c) solidifying said at least one molten metal charge into at least one metal ingot by cooling said at least one ingot mould containing said at least one molten metal charge to a cooling temperature $T_{rf}$ that is lower than said melting temperature $T_f$ and higher than the ambient temperature $T_a$ until said at least one molten metal charge is solidified into said at least one metal ingot, d) extracting said at least one metal ingot from said at least one ingot mould at an extraction temperature $T_e$, and e) repeating said filling a), said melting b), said solidifying c), and said extracting d), wherein, at a steady state, the extraction temperature $T_e$ and the filling temperature $T_{rp}$ are lower than or equal to said cooling temperature $T_{rf}$ and higher than said ambient temperature $T_a$.

2. The process according to claim 1, wherein said melting temperature $T_f$ is higher than 600° C., said cooling temperature $T_{rf}$ is lower than said melting temperature $T_f$ and higher than or equal to 400° C., and said extraction temperature $T_e$ and said filling temperature $T_{rp}$ are lower than or equal to said cooling temperature $T_{rf}$ and higher than or equal to 400° C.

3. The process according to claim 1, wherein said extraction temperature $T_e$ and said filling temperature $T_{rp}$ are substantially equal to each other.

4. The process according to claim 1, wherein said extraction temperature $T_e$ and said filling temperature $T_{rp}$ are substantially equal to said cooling temperature $T_{rf}$.

5. The process according to claim 1, wherein said at least one metal charge in the solid state comprises particles, powders, granules, and/or fragments of at least one metal material selected from the group consisting of a precious metal and a non-precious metal of a non-ferrous type, in pure form or an alloy thereof, said precious metal is at least one selected from the group consisting of gold, silver, platinum, and palladium, and said non-precious metal of a non-ferrous type is at least one selected from the group consisting of copper and aluminium.

6. The process according to claim 5, wherein said cooling temperature $T_{rf}$ is lower than said melting temperature $T_f$ by no more than 300° C., and said extraction temperature $T_e$ and said filling temperature $T_{rp}$ are lower than or equal to said cooling temperature $T_{rf}$ and higher than or equal to 400° C.

7. The process according to claim 5, wherein said at least one metal material comprises pure silver, whose melting temperature is approximately 961° C., said cooling temperature $T_{rf}$ ranges from 700° C. to 900° C., and said extraction temperature $T_e$ and said filling temperature $T_{rp}$ are lower than or equal to said cooling temperature $T_{rf}$ and higher than or equal to 400° C.

8. The process according to claim 5, wherein said at least one metal material comprises pure gold, whose melting temperature $T_f$ is approximately 1063° C., said cooling temperature $T_{rf}$ ranges from 800° C. to 1000° C., and said extraction temperature $T_e$ and said filling temperature $T_{rp}$ are lower than or equal to said cooling temperature $T_{rf}$ and higher than or equal to 400° C.

9. The process according to claim 1, wherein each of said filling a), said melting b), said solidifying c), and said extracting d) is carried out in a substantially inert atmosphere or in a vacuum condition.

10. The process according claim 1, further comprising:

f) cooling said at least one metal ingot extracted from said at least one ingot mould to the ambient temperature $T_a$.

11. An apparatus for producing at least one metal ingot, the apparatus comprising:

at least one ingot mould;

at least one filling unit for filling said at least one ingot mould with at least one metal charge in a solid state having a melting temperature $T_f$ for forming said at least one metal ingot;

at least one heat treatment unit for heating said at least one ingot mould to a heating temperature $T_{rs}$ that is higher than or equal to the melting temperature $T_f$ for melting said at least one metal charge in the solid state to obtain a molten metal charge and for natural or forced cooling of said at least one ingot mould to a cooling temperature $T_{rf}$ that is lower than said melting temperature $T_f$ and higher than ambient temperature $T_a$ for solidifying said molten metal charge into said at least one metal ingot;

at least one extraction unit for extracting said at least one metal ingot from said at least one ingot mould; and at least one control unit configured to control said at least one filling unit, said at least one heat treatment unit, and said at least one extraction unit so as to carry out the process according to claim 1.

12. The apparatus according to claim 11, further comprising at least one temperature detecting device for detecting temperature of said at least one ingot mould which is operatively connected to said at least one control unit, and said at least one control unit is configured to control said at least one filling unit, said at least one heat treatment unit, and said at least one extraction unit as a function of the temperature detected by said at least one temperature detecting device.

13. The apparatus according to claim 11, wherein said at least one heat treatment unit comprises:

at least one heating unit for heating said at least one ingot mould to the heating temperature $T_{rs}$.

14. The apparatus according to claim 13, wherein said at least one heat treatment unit comprises:

at least one cooling unit for cooling said at least one ingot mould to the cooling temperature $T_{rf}$.

15. The apparatus according to claim 14, further comprising at least one handling assembly for moving said at least one ingot mould between said at least one filling unit, said at least one heat treatment unit, and said at least one extraction unit, and said at least one handling assembly is controlled by said at least one control unit.

16. The apparatus according to claim 15, comprising at least one closed chamber containing:

said at least one heat treatment unit, said at least one extraction unit, and said at least one ingot mould, wherein said at least one filling unit comprises at least one dosing chamber provided with at least one discharge port for discharging said at least one metal charge into said at least one ingot mould, said at least one discharge port being closed by a respective on-off valve and leading into said at least one closed chamber.

17. The apparatus according to claim 16, wherein said at least one handling assembly is associated with said at least one closed chamber to operate on said at least one ingot mould.

18. The apparatus according to claim 16, further comprising:

at least one unit connected to said at least one closed chamber for generating a substantially inert atmosphere or vacuum conditions within said at least one closed chamber.

19. The apparatus according to claim 18, wherein said at least one closed chamber is divided into two or more compartments, each of which houses one or more of said at least one heat treatment unit, said at least one extraction unit, and said at least one discharge port of said at least one filling unit, said compartments being mutually in communication through movable walls or barriers and/or tunnel paths intercepted by respective movable walls or barriers, and said at least one unit is connected to said at least one closed chamber for generating, within each of said compartments and of said tunnel paths, the substantially inert atmosphere or vacuum conditions.

20. The apparatus according to claim 16, wherein said at least one dosing chamber of said at least one filling unit comprises at least one feeding port for feeding said at least one metal charge in the solid state inside said at least one dosing chamber and said at least one feeding port is closed by a respective on-off valve.

21. The apparatus according to claim 20, further comprising an auxiliary unit that is connected to said at least one dosing chamber of said at least one filling unit for generating an inert atmosphere or vacuum conditions within said at least one filling unit.

22. The apparatus according to claim 16, further comprising at least one removal unit for removing said at least one metal ingot extracted from said at least one ingot mould from said at least one closed chamber.

23. The apparatus according to claim 22, wherein said at least one removal unit is housed in a compartment, which is in communication with said at least one closed chamber and with an environment outside said at least one closed chamber and is provided with at least one barrier isolating an atmosphere inside said at least one closed chamber from the environment outside said at least one closed chamber.

24. The apparatus according to claim 22, further comprising at least one cooling assembly for cooling said at least one metal ingot extracted from said at least one ingot mould to the ambient temperature $T_a$.

25. The apparatus according to claim 24, wherein said at least one cooling assembly comprises at least one tank containing a cooling liquid that is at least partially housed in said at least one closed chamber through an opening on walls of said at least one closed chamber and forming a shutter.

26. The apparatus according to claim 25, wherein said at least one removal unit is housed in said at least one tank.

27. The apparatus according to claim 16, wherein said at least one heat treatment unit comprises:

at least a first heating unit, a second heating unit, and a single cooling unit, which are positioned inside said at least one closed chamber, and at least a first ingot mould and a second ingot mould, which are housed in said at least one closed chamber; and in steady state operating conditions, there are alternating periods of operation in which said first ingot mould is heated by said first heating unit, while said second ingot mould is cooled by said single cooling unit, and periods of operation in which said first ingot mould is cooled by said single cooling unit, while said second ingot mould is heated by said second heating unit, said at least one handling assembly being arranged to displace said first ingot mould between said first heating unit, said single cooling unit, said at least one extraction unit, and said at least one filling unit, and to displace said second ingot mould between said second heating unit, said single cooling unit, said at least one extraction unit, and said at least one filling unit.

* * * * *